US011420463B2

(12) United States Patent
Okuda et al.

(10) Patent No.: US 11,420,463 B2
(45) Date of Patent: Aug. 23, 2022

(54) INK JET RECORDING METHOD AND INK JET RECORDING APPARATUS

(71) Applicant: Seiko Epson Corporation, Tokyo (JP)

(72) Inventors: Ippei Okuda, Shiojiri (JP); Tadashi Watanabe, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/944,590

(22) Filed: Jul. 31, 2020

(65) Prior Publication Data

US 2021/0031552 A1 Feb. 4, 2021

(30) Foreign Application Priority Data

Aug. 1, 2019 (JP) ..... JP2019-142067

(51) Int. Cl.
*B41J 2/15* (2006.01)
*B41M 7/00* (2006.01)
*B41J 2/18* (2006.01)

(52) U.S. Cl.
CPC ..... *B41M 7/0036* (2013.01); *B41J 2/18* (2013.01)

(58) Field of Classification Search
None
See application file for complete search history.

(56) References Cited

U.S. PATENT DOCUMENTS

2015/0049147 A1* 2/2015 Nakano ..... B41J 2/17513 347/87
2015/0191031 A1* 7/2015 Ohta ..... C09D 11/322 428/207
2017/0166768 A1 6/2017 Matsuzaki et al.
2018/0015722 A1* 1/2018 Kasai ..... B41J 2/1404
2018/0051182 A1* 2/2018 Lussier ..... C09D 11/30
2018/0207940 A1* 7/2018 Yoda ..... B41J 2/04551
2018/0257388 A1* 9/2018 Tashiro ..... C09D 11/105

FOREIGN PATENT DOCUMENTS

JP 2016159514 A * 9/2016
JP 2017-110185 A 6/2017
JP 2018103418 A * 7/2018 ..... B41J 2/14233

* cited by examiner

*Primary Examiner* — Erica S Lin
*Assistant Examiner* — Tracey M McMillion
(74) *Attorney, Agent, or Firm* — Harness, Dickey & Pierce, P.L.C.

(57) ABSTRACT

Provided is an ink jet recording method using an ink jet recording apparatus having an ink jet head, the method including: a colored ink adhesion step of discharging an aqueous colored ink composition containing a coloring material from an ink jet head to adhere to a recording medium; and a clear ink adhesion step of discharging an aqueous clear ink composition from an ink jet head to adhere to the recording medium, in which the aqueous clear ink composition contains wax particles, the ink jet recording apparatus has a circulation path for circulating the aqueous clear ink composition, and in the clear ink adhesion step, the aqueous clear ink composition circulated in the circulation path is discharged.

12 Claims, 9 Drawing Sheets

INK JET RECORDING METHOD AND INK JET RECORDING APPARATUS

The present application is based on, and claims priority from JP Application Serial Number 2019-142067, filed Aug. 1, 2019, the disclosure of which is hereby incorporated by reference herein in its entirety.

BACKGROUND

1. Technical Field

The present disclosure relates to an ink jet recording method and an ink jet recording apparatus.

2. Related Art

Ink jet recording methods are rapidly developing in various fields since it is possible to record high-definition images with a relatively simple device. In particular, various studies have been made on a discharge stability and the like. For example, JP-A-2017-110185 describes an ink composition containing a wax.

After printing a colored ink composition, a clear ink composition may be printed on the printed surface to cover the surface. When clear ink contains wax particles to improve an abrasion resistance of a surface of a recorded matter, a problem such as clogging of a head filter occurs.

SUMMARY

The present inventors have conducted intensive studies and found that, by circulating a clear ink composition, the recorded matter exhibits an excellent abrasion resistance and that the generation of the foreign substances is suppressed, and have completed the present disclosure.

According to an aspect of the present disclosure, there is provided an ink jet recording method that uses an ink jet recording apparatus having an ink jet head, the method including a colored ink adhesion step of discharging an aqueous colored ink composition containing a coloring material from an ink jet head to adhere to a recording medium, and a clear ink adhesion step of discharging an aqueous clear ink composition from the ink jet head to adhere to the recording medium, in which the aqueous clear ink composition contains wax particles, the ink jet recording apparatus has a circulation path for circulating the aqueous clear ink composition, and in the clear ink adhesion step, the aqueous clear ink composition circulated in the circulation path is discharged.

In the method, adhering a treatment liquid containing a coagulant to the recording medium may be included.

According to another aspect of the present disclosure, there is provided an ink jet recording apparatus that performs recording by the ink jet recording method described above, the apparatus including a first ink jet head that discharges an aqueous colored ink composition containing a coloring material to adhere to a recording medium, a second ink jet head that discharges an aqueous clear ink composition to adhere to the recording medium, and a circulation path for circulating the aqueous clear ink composition.

In the method, the aqueous clear ink composition may contain 1% by mass or more of the wax particles. The wax particles may have an average particle diameter of 30 nm to 500 nm. The aqueous clear ink composition may contain resin particles, or a nitrogen-containing solvent.

In the method, the recording medium may be a low-absorptive recording medium or a non-absorptive recording medium.

In the method, the circulation path may include at least one of a circulation return path for returning an aqueous clear ink composition from the ink flow path for supplying the aqueous clear ink composition to the ink jet head, and a circulation return path for returning the aqueous clear ink composition from the ink jet head. In the method, a gas-liquid interface may be generated in a circulation path for circulating the aqueous clear ink composition. In the method, the ink jet recording apparatus may circulate the aqueous clear ink composition during standby. In the method, the circulation amount of the aqueous clear ink composition in the circulation return path during the standby may be 0.5 to 12 g/min per one ink jet head.

In the method, the ink jet recording apparatus may have the circulation path for circulating the aqueous colored ink composition, and in the colored ink adhesion step, the colored ink composition circulated in the circulation path may be discharged.

DESCRIPTION OF EXEMPLARY EMBODIMENTS

Figure 1:
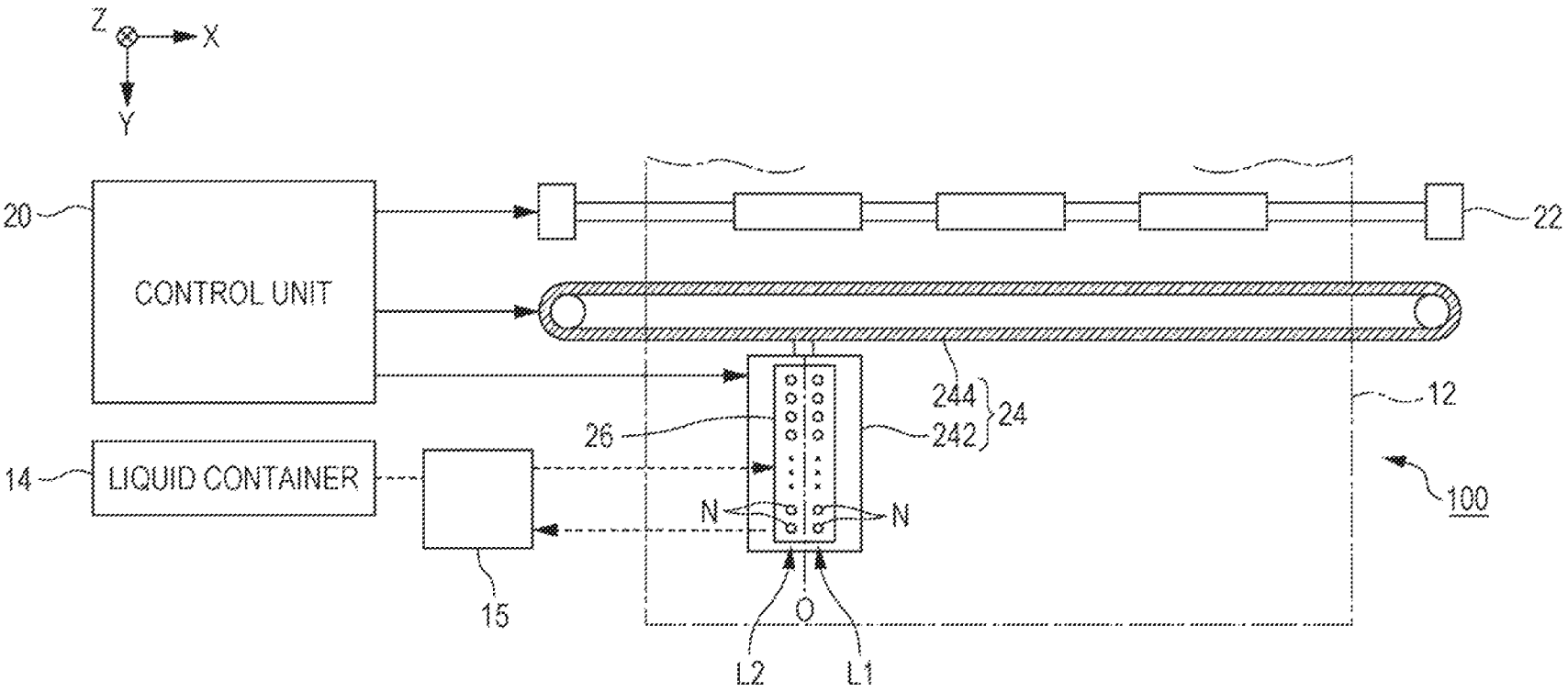
FIG. 1 is a configuration diagram of an ink jet recording apparatus according to a first embodiment of the present disclosure.

Hereinafter, an embodiment of the present disclosure (hereinafter, referred to as "the present embodiment") will be described in detail with reference to the drawings as necessary, but the present disclosure is not limited to this, and various modifications can be made without departing from the gist of the present disclosure. In the drawings, the same elements will be denoted by the same reference numerals, and the duplicate description will be omitted. In addition, the positional relationship such as up, down, left, and right is based on the positional relationship shown in the drawings unless otherwise specified. Further, the dimensional ratios in the drawings are not limited to the illustrated ratios.

The ink jet recording method of the present embodiment is an ink jet recording method using an ink jet recording apparatus having an ink jet head, including a colored ink adhesion step of discharging an aqueous colored ink composition (hereinafter, also simply referred to as "colored ink composition") containing a coloring material from an ink jet head and adhering the aqueous colored ink composition to a recording medium, and a clear ink adhesion step of discharging an aqueous clear ink composition (hereinafter, also simply referred to as "clear ink composition") from an ink jet head and adhering the aqueous clear ink composition to a recording medium. The aqueous clear ink composition contains wax particles. Further, the ink jet recording apparatus has a circulation path for circulating the clear ink composition, and in the clear ink adhesion step, the aqueous clear ink composition circulated in the circulation path is discharged.

According to the above configuration, it is possible to provide an ink jet recording method that shows an excellent abrasion resistance of a recorded matter and suppresses generation of the foreign substances. Also, according to the above configuration, it is possible to improve a discharge stability of an ink composition from a head. Further, according to the above configuration, an unevenness of the recorded matter is suppressed by suppressing a bleeding. In addition, according to the above configuration, an image deviation of the recorded matter is suppressed.

Note that, it is considered that a colored ink composition containing a coloring material causes ink discharge failure due to thickening of the ink composition in the ink jet head due to drying, or generation of the foreign substances such as precipitates in the ink composition. On the other hand, by circulating the ink composition using a head having a circulation path for circulating the ink composition and mixing the ink composition with a new ink composition to supply the mixed ink composition to the nozzles again, the discharge failure is suppressed. It is considered that the circulation of the ink composition suppresses the aggregation of the components in the ink composition, thereby suppressing the thickening and the generation of the foreign substances. The components that cause the ink composition to thicken or generate foreign substances are considered to be mainly pigments, and it is considered that the components become aggregates and foreign substances due to the decrease in the dispersion stability of the pigment due to the drying of the ink composition.

On the other hand, after printing the colored ink composition, by printing the clear ink composition on the printed surface to cover the surface, an excellent abrasion resistance can be obtained. It was believed that the clear ink did not have to circulate in the ink jet recording apparatus. This is because the clear ink does not contain a pigment which mainly causes thickening and generation of foreign substances. However, when the ink jet recording apparatus is actually operated, even an ink jet head that discharges clear ink has problems due to the reduced discharge stability and clogging of a head filter due to the generation of the foreign substances. Therefore, when an attempt was made to determine the cause, when the clear ink contains wax particles in order to improve the abrasion resistance of the surface of the recorded matter, it has been found that the wax particles easily become foreign substances in the ink flow path, and the foreign substances cause the clogging of the head filter. Therefore, the ink jet recording method using clear ink containing a wax was found to be excellent in suppressing the generation of the foreign substances while obtaining excellent abrasion resistance of the recorded matter by using a head having a circulation path for circulating the ink composition.

Ink Jet Recording Apparatus

The ink jet recording apparatus of the present embodiment may be a line printer or a serial printer. The line printer is a printer of a system in which an ink jet head is formed to be wider than a recording width or more of a recorded medium, and discharges droplets onto the recorded medium without moving the ink jet head. The serial printer is a printer of a system in which an ink jet head is mounted on a carriage that moves in a predetermined direction, and the ink jet head moves along with the movement of the carriage to discharge droplets onto a recorded medium.

The ink jet recording apparatus of the present embodiment may be an on-carriage type printer in which an ink cartridge is mounted on a carriage, or may be an off-carriage type printer in which an ink cartridge is provided outside a carriage. In the following, an ink jet recording apparatus according to the present embodiment will be described taking a line printer or an off-carriage type printer as an example.

The ink jet recording apparatus has a circulation path for circulating a clear ink composition. The clear ink composition containing wax particles is liable to generate foreign substances, which causes the clogging and the like of the head filter. However, the generation of the foreign substances is suppressed by circulating the clear ink composition. The circulation path includes at least one of a circulation return path for returning a clear ink composition from an ink flow path for supplying the clear ink composition to the ink jet head, and a circulation return path for returning the clear ink composition from the ink jet head. Among these, from the viewpoint of more remarkably suppressing the generation of the foreign substances, an ink jet recording apparatus including a circulation return path for returning the clear ink composition from the ink jet head is preferable. Note that, in the following ink jet recording apparatus of the present embodiment, an apparatus including a circulation return path for returning a clear ink composition from an ink jet head will be described as an example. The ink jet recording apparatus preferably has a circulation path for circulating a colored ink composition.

First Embodiment

FIG. 1 is a configuration diagram illustrating an ink jet recording apparatus 100 used in the first embodiment. The ink jet recording apparatus 100 used in the first embodiment is an ink jet printing apparatus that ejects an ink composition onto a medium 12. The medium 12 is typically printing paper, but a recording medium of any material such as a resin film or a cloth can be used as the medium 12. As illustrated in FIG. 1, a liquid container 14 that stores an ink composition is installed in the ink jet recording apparatus 100. For example, a cartridge that can be attached to and detached from the ink jet recording apparatus 100, a bag-shaped ink pack formed of a flexible film, or an ink tank that can replenish the ink composition is used as the liquid container 14. A plurality of types of ink compositions having different colors may be stored in the liquid container 14. The ink may be supplied from the liquid container 14 to a sub-tank 15, and the ink may be stored in the sub-tank and then supplied to the ink jet head. Although not shown, a self-sealing valve is provided in a flow path through which ink is supplied from the sub-tank 15 to the ink jet head. Further downstream, a filter for capturing foreign substances may be provided.

As illustrated in FIG. 1, the ink jet recording apparatus 100 includes a control unit 20, a transport mechanism 22, a moving mechanism 24, and an ink jet head 26. The control unit 20 includes, for example, a processing circuit such as a Central Processing Unit (CPU) and a Field Programmable Gate Array (FPGA) and a storage circuit such as a semiconductor memory, and controls each element of the ink jet recording apparatus 100 in an integrated manner. The transport mechanism 22 transports the medium 12 in a Y direction under the control of the control unit 20.

The moving mechanism 24 reciprocates the ink jet head 26 in an X direction under the control of the control unit 20. The X direction is a direction intersecting (typically, orthogonal) to the Y direction in which the medium 12 is transported. The moving mechanism 24 of the first embodiment includes a substantially box-shaped transport body 242 (carriage) that houses the ink jet head 26, and a transport belt 244 to which the transport body 242 is fixed. Note that, a configuration in which a plurality of ink jet heads 26 are mounted on the transport body 242 or a configuration in which the liquid container 14 is mounted on the transport body 242 together with the ink jet heads 26 may be adopted.

The ink jet head 26 ejects the ink supplied from the liquid container 14 from a plurality of nozzles N (ejection holes) to the medium 12 under the control of the control unit 20. A desired image is formed on the surface of the medium 12 by each ink jet head 26 ejecting ink onto the medium 12 in parallel with the transport of the medium 12 by the transport mechanism 22 and the repetitive reciprocation of the transport body 242. A direction perpendicular to an X-Y plane (for example, a plane parallel to the surface of the medium 12) is hereinafter referred to as a Z direction. The direction (typically, a vertical direction) of ink ejection by each ink jet head 26 corresponds to the Z direction.

As illustrated in FIG. 1, the plurality of nozzles N of the ink jet head 26 are arranged in the Y direction. The plurality of nozzles N of the first embodiment are divided into a first row L1 and a second row L2, which are arranged side by side at intervals in the X direction. Each of the first row L1 and the second row L2 is a set of the plurality of nozzles N arranged linearly in the Y direction. Although it is possible to make the position of each nozzle N different in the Y direction between the first row L1 and the second row L2 (that is, zigzag or staggered), a configuration in which the position of each nozzle N in the Y direction is matched in the first row L1 and the second row L2 will be exemplified below for convenience. In the following description, a plane (Y-Z plane) 0 passing through a central axis parallel to the Y direction and parallel to the Z direction in the ink jet head 26 is referred to as a "center plane".

Figure 2:
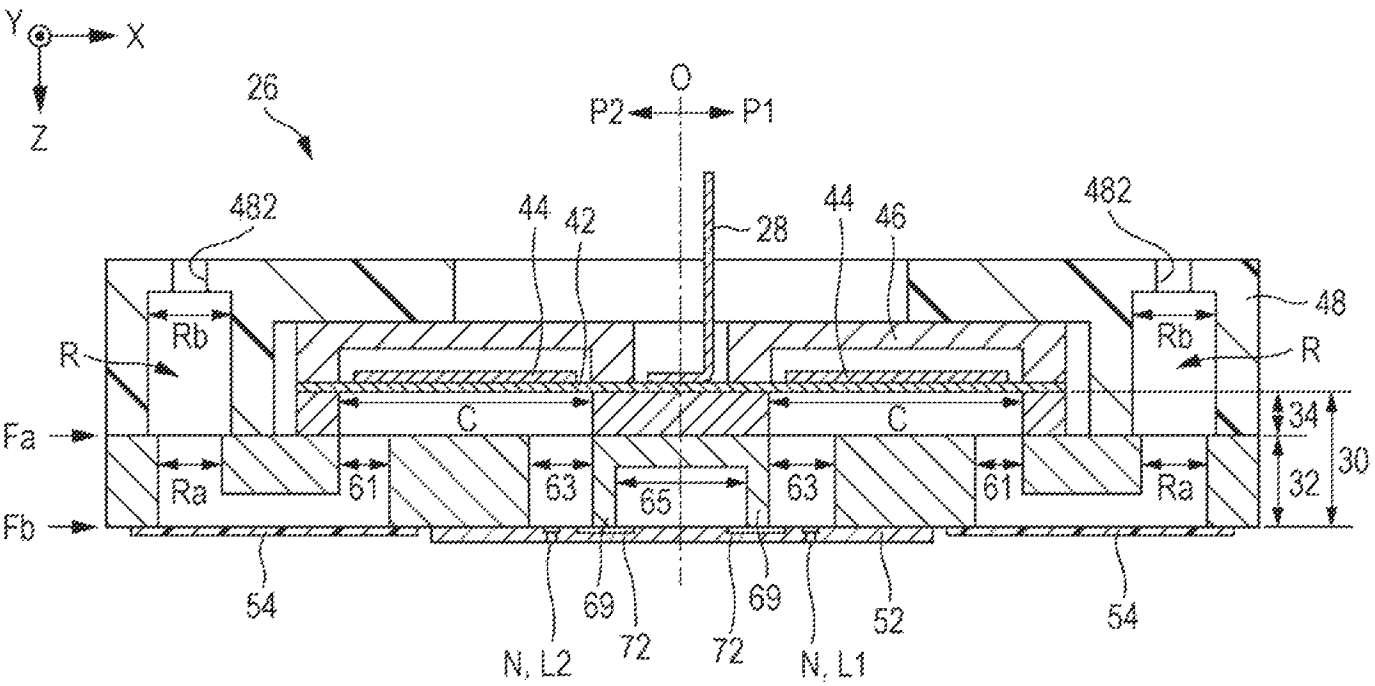
FIG. 2 is a sectional diagram of an ink jet head.
Figure 3:
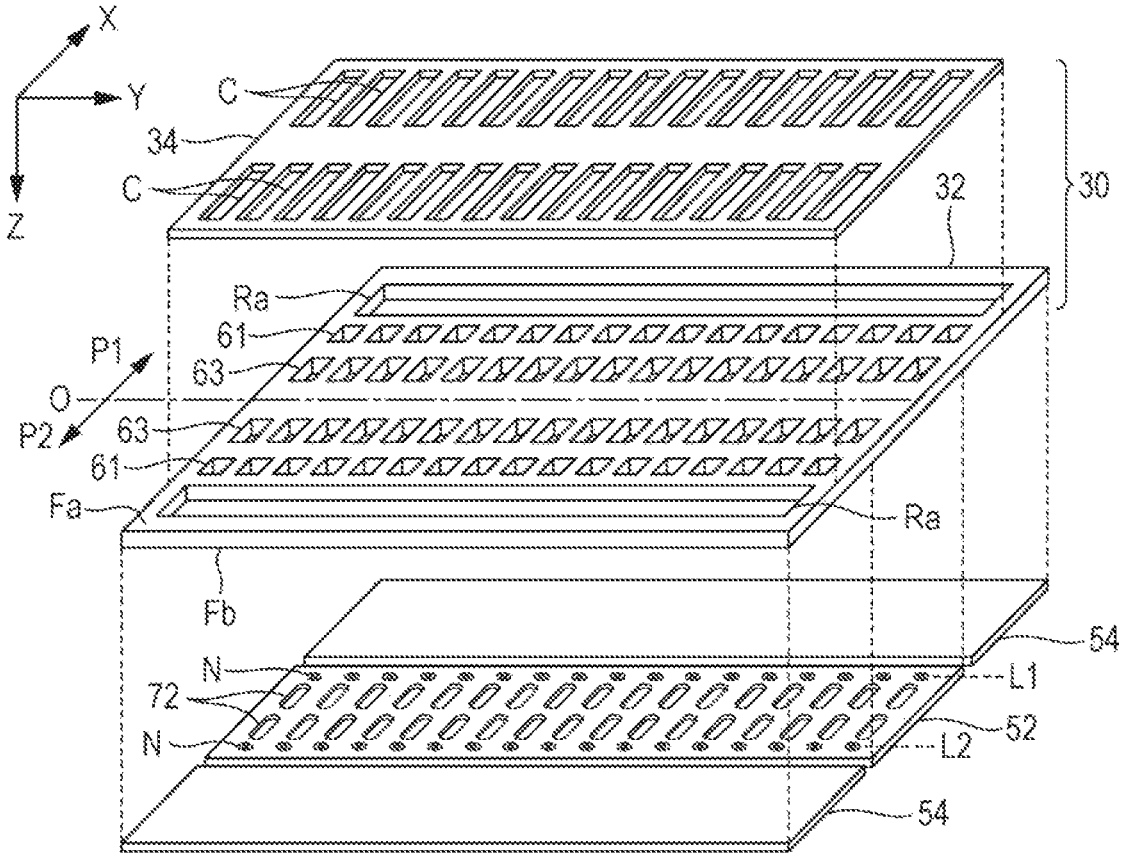
FIG. 3 is a partial exploded perspective diagram of an ink jet head.

FIG. 2 is a sectional diagram of the ink jet head 26 in a section perpendicular to the Y direction, and FIG. 3 is a partial exploded perspective diagram of the ink jet head 26. As understood from FIGS. 2 and 3, the ink jet head 26 of the first embodiment has a structure in which elements related to each nozzle N in the first row L1 (example of the first nozzle) and elements related to each nozzle N in the second row L2 (example of the second nozzle) are arranged symmetrically with respect to the center plane O. That is, in the ink jet head 26, the structure is substantially common between a part P1 (hereinafter, referred to as a "first part") on a positive side in the X direction and a part P2 (hereinafter, referred to as a "second part") on a negative side in the X direction across the center plane O. The plurality of nozzles N in the first row L1 are formed in the first part P1, and the plurality of nozzles N in the second row L2 are formed in the second part P2. The center plane O corresponds to a boundary between the first part P1 and the second part P2.

As illustrated in FIGS. 2 and 3, the ink jet head 26 includes a flow path forming portion 30. The flow path forming portion 30 is a structure that forms a flow path for supplying ink to the plurality of nozzles N. The flow path forming portion 30 according to the first embodiment is configured by laminating a first flow path substrate 32 (communication plate) and a second flow path substrate 34 (pressure chamber forming plate). Each of the first flow path substrate 32 and the second flow path substrate 34 is a plate-like member elongated in the Y direction. The second flow path substrate 34 is installed on a surface Fa of the first flow path substrate 32 on the negative side in the Z direction using, for example, an adhesive.

As illustrated in FIG. 2, in addition to the second flow path substrate 34, a vibration section 42, a plurality of piezoelectric elements 44, a protection member 46, and a housing portion 48 are installed on the surface Fa of the first flow path substrate 32 (not shown in FIG. 3). On the other hand, a nozzle plate 52 and a vibration absorber 54 are installed on a front surface Fb of the first flow path substrate 32 on the positive side (that is, on the side opposite to the surface Fa) in the Z direction. Each element of the ink jet head 26 is a plate-like member that is substantially elongated in the Y direction like the first flow path substrate 32 and the second flow path substrate 34, and is joined to each other using, for example, an adhesive. The direction in which the first flow path substrate 32 and the second flow path substrate 34 are laminated and the direction in which the first flow path substrate 32 and the nozzle plate 52 are laminated (or the direction perpendicular to the surface of each plate-like element) can be grasped as the Z direction.

The nozzle plate 52 is a plate-like member on which a plurality of nozzles N are formed, and is installed on the surface Fb of the first flow path substrate 32 using, for example, an adhesive. Each of the plurality of nozzles N is a circular through-hole through which the ink composition passes. In the nozzle plate 52 of the first embodiment, a plurality of nozzles N configuring the first row L1 and a plurality of nozzles N configuring the second row L2 are formed. Specifically, a plurality of nozzles N in the first row L1 are formed along the Y direction in a region on the positive side in the X direction as viewed from the center plane O of the nozzle plate 52, and a plurality of nozzles N in the second row L2 are formed along the Y direction in a region on the negative side in the X direction. The nozzle plate 52 of the first embodiment is a single plate-like member that is continuous over a part where the plurality of nozzles N of the first row L1 are formed and a part where the plurality of nozzles N of the second row L2 are formed. The nozzle plate 52 of the first embodiment is manufactured by processing a single crystal substrate of silicon (Si) by using a semiconductor manufacturing technique (for example, a processing technology such as dry etching and wet etching). However, a known material and a manufacturing method can be optionally adopted for manufacturing the nozzle plate 52.

As illustrated in FIGS. 2 and 3, a space Ra, a plurality of supply paths 61, and a plurality of communication paths 63 are formed in the first flow path substrate 32 for each of the first part P1 and the second part P2. The space Ra is an elongated opening formed along the Y direction in plan view (that is, as viewed from the Z direction), and the supply paths 61 and the communication paths 63 are through-holes formed for each nozzle N. The plurality of communication paths 63 are arranged in the Y direction in plan view, and the plurality of supply paths 61 are arranged between the arrangement of the plurality of communication paths 63 and the space Ra in the Y direction. The plurality of supply paths 61 communicate with the space Ra in common. Further, any one communication path 63 overlaps a nozzle N corresponding to the communication path 63 in plan view. Specifically, any one communication path 63 of the first part P1 communicates with one nozzle N corresponding to the communication path 63 in the first row L1. Similarly, any one communication path 63 of the second part P2 communicates with one nozzle N corresponding to the communication path 63 in the second row L2.

As illustrated in FIGS. 2 and 3, the second flow path substrate 34 is a plate-like member in which a plurality of pressure chambers C are formed for each of the first part P1 and the second part P2. The plurality of pressure chambers C are arranged in the Y direction. Each pressure chamber C (cavity) is a long space formed for each nozzle N and extending along the X direction in plan view. The first flow path substrate 32 and the second flow path substrate 34 are manufactured by processing a silicon single crystal substrate by using, for example, a semiconductor manufacturing technique, similarly to the nozzle plate 52 described above. However, a known material and a manufacturing method can be optionally adopted for manufacturing the first flow path substrate 32 and the second flow path substrate 34. As described above, the flow path forming portion 30 (the first flow path substrate 32 and the second flow path substrate 34) and the nozzle plate 52 of the first embodiment include a substrate formed of silicon. Therefore, there is an advantage that a fine flow path can be formed with high accuracy in the flow path forming portion 30 and the nozzle plate 52 by using the semiconductor manufacturing technique as described above, for example.

As illustrated in FIG. 2, a vibration section 42 is installed on the surface of the second flow path substrate 34 opposite to the first flow path substrate 32. The vibration section 42 of the first embodiment is a plate-like member (vibrating plate) that can elastically vibrate. The second flow path substrate 34 and the vibration section 42 can be integrally formed by selectively removing a part of the plate-like member having a predetermined thickness in a region corresponding to the pressure chamber C in the thickness direction.

As understood from FIG. 2, the surface Fa of the first flow path substrate 32 and the vibration section 42 face each other at an interval inside each pressure chamber C. The pressure chamber C is a space located between the surface Fa of the first flow path substrate 32 and the vibration section 42, and generates a pressure change in the ink filled in the space. Each pressure chamber C is a space of which a longitudinal direction is, for example, the X direction, and is formed individually for each nozzle N. In each of the first row L1 and the second row L2, a plurality of pressure chambers C are arranged in the Y direction. As illustrated in FIGS. 2 and 3, an end of any one of the pressure chambers C on the center plane O side overlaps the communication path 63 in plan view, and an end of the pressure chambers C on the side opposite to the center plane O overlaps the supply path 61 in plan view. Therefore, in each of the first part P1 and the second part P2, the pressure chamber C communicates with the nozzle N through the communication path 63 and communicates with the space Ra through the supply path 61. It is also possible to add a predetermined flow path resistance by forming a narrowed flow path having a narrow flow path width in the pressure chamber C.

As illustrated in FIG. 2, a plurality of piezoelectric elements 44 corresponding to different nozzles N are installed in each of the first part P1 and the second part P2 on the surface of the vibration section 42 opposite to the pressure chamber C. The piezoelectric element 44 is a passive element that is deformed by supplying a drive signal. The plurality of piezoelectric elements 44 are arranged in the Y direction so as to correspond to each pressure chamber C.

Figure 4:
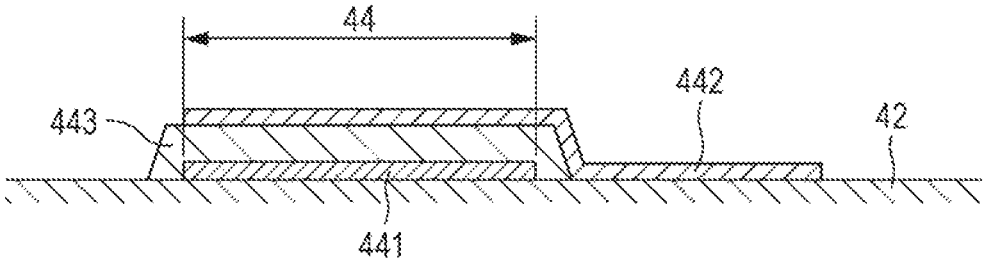
FIG. 4 is a sectional diagram of a piezoelectric element.

As illustrated in FIG. 4, any one piezoelectric element 44 is a laminate in which a piezoelectric layer 443 is interposed between a first electrode 441 and a second electrode 442 that face each other. Note that, one of the first electrode 441 and the second electrode 442 may be a continuous electrode (that is, a common electrode) across the plurality of piezoelectric elements 44. A part where the first electrode 441, the second electrode 442, and the piezoelectric layer 443 overlap in plan view functions as the piezoelectric element 44. Note that, a part that is deformed by the supply of the drive signal (that is, an active portion that vibrates the vibration section 42) can be defined as the piezoelectric element 44. As understood from the above description, the ink jet head 26 of the first embodiment includes a first piezoelectric element and a second piezoelectric element. For example, the first piezoelectric element is the piezoelectric element 44 on one side in the X direction (for example, the right side in FIG. 2) as viewed from the center plane O, and the second piezoelectric element is the piezoelectric element 44 on the other side in the X direction (for example, the left side in FIG. 2) as viewed from the center plane O. When the vibration section 42 vibrates in conjunction with the deformation of the piezoelectric element 44, the pressure in the pressure chamber C fluctuates, and the ink filled in the pressure chamber C is ejected through the communication path 63 and the nozzle N.

The protection member 46 in FIG. 2 is a plate-like member for protecting the plurality of piezoelectric elements 44, and is installed on the surface of the vibration section 42 (or the surface of the second flow path substrate 34). Although the material and the manufacturing method of the protection member 46 are optional, similar to the first flow path substrate 32 and the second flow path substrate 34, the protection member 46 can be formed by processing a single crystal substrate of silicon (Si) by a semiconductor manufacturing technique, for example. The plurality of piezoelectric elements 44 are housed in recesses formed on the surface of the protection member 46 on the side of the vibration section 42.

The end of the wiring substrate 28 is joined to the surface of the vibration section 42 on the side opposite to the flow path forming portion 30 (or the surface of the flow path forming portion 30). The wiring substrate 28 is a flexible mounting component on which a plurality of wirings (not shown) for electrically coupling the control unit 20 and the ink jet head 26 are formed. An end of the wiring substrate 28 that extends to the outside through an opening formed in the protection member 46 and an opening formed in the housing portion 48 is coupled to the control unit 20. For example, a flexible wiring substrate 28 such as a Flexible Printed Circuit (FPC) and a Flexible Flat Cable (FFC) is preferably used.

The housing portion 48 is a case for storing ink supplied to the plurality of pressure chambers C (further, the plurality of nozzles N). The surface of the housing portion 48 on the positive side in the Z direction is joined to the surface Fa of the first flow path substrate 32 with, for example, an adhesive. Known techniques and manufacturing methods can be optionally adopted for manufacturing the housing portion 48. For example, the housing portion 48 can be formed by injection molding of a resin material.

As illustrated in FIG. 2, a space Rb is formed in each of the first part P1 and the second part P2 in the housing portion 48 of the first embodiment. The space Rb of the housing portion 48 and the space Ra of the first flow path substrate 32 communicate with each other. The space formed by the space Ra and the space Rb functions as a liquid storage chamber (reservoir) R for storing the ink supplied to the plurality of pressure chambers C. The liquid storage chamber R is a common liquid chamber shared by a plurality of nozzles N. A liquid storage chamber R is formed in each of the first part P1 and the second part P2. The liquid storage chamber R of the first part P1 is located on the positive side in the X direction as viewed from the center plane O, and the liquid storage chamber R of the second part P2 is located on the negative side in the X direction as viewed from the center plane O. An inlet 482 for introducing ink supplied from the liquid container 14 into the liquid storage chamber R is formed on a surface of the housing portion 48 opposite to the first flow path substrate 32. Although not shown, a heater for heating the ink is preferably provided on the wall surface of the Rb.

As illustrated in FIG. 2, on the surface Fb of the first flow path substrate 32, a vibration absorber 54 is installed for each of the first part P1 and the second part P2. The vibration absorber 54 is a flexible film (compliance substrate) that absorbs pressure fluctuations of the ink in the liquid storage chamber R. As illustrated in FIG. 3, the vibration absorber 54 is installed on the surface Fb of the first flow path substrate 32 so as to close the space Ra and the plurality of supply paths 61 of the first flow path substrate 32, and configures the wall surface (specifically, the bottom surface) of the liquid storage chamber R.

As illustrated in FIG. 2, a space (hereinafter, referred to as a "circulating liquid chamber") 65 is formed on the surface Fb of the first flow path substrate 32 facing the nozzle plate 52. The circulating liquid chamber 65 of the first embodiment is an elongated bottomed hole (groove) extending in the Y direction in plan view. The opening of the circulating liquid chamber 65 is closed by the nozzle plate 52 joined to the surface Fb of the first flow path substrate 32.

Figure 5:
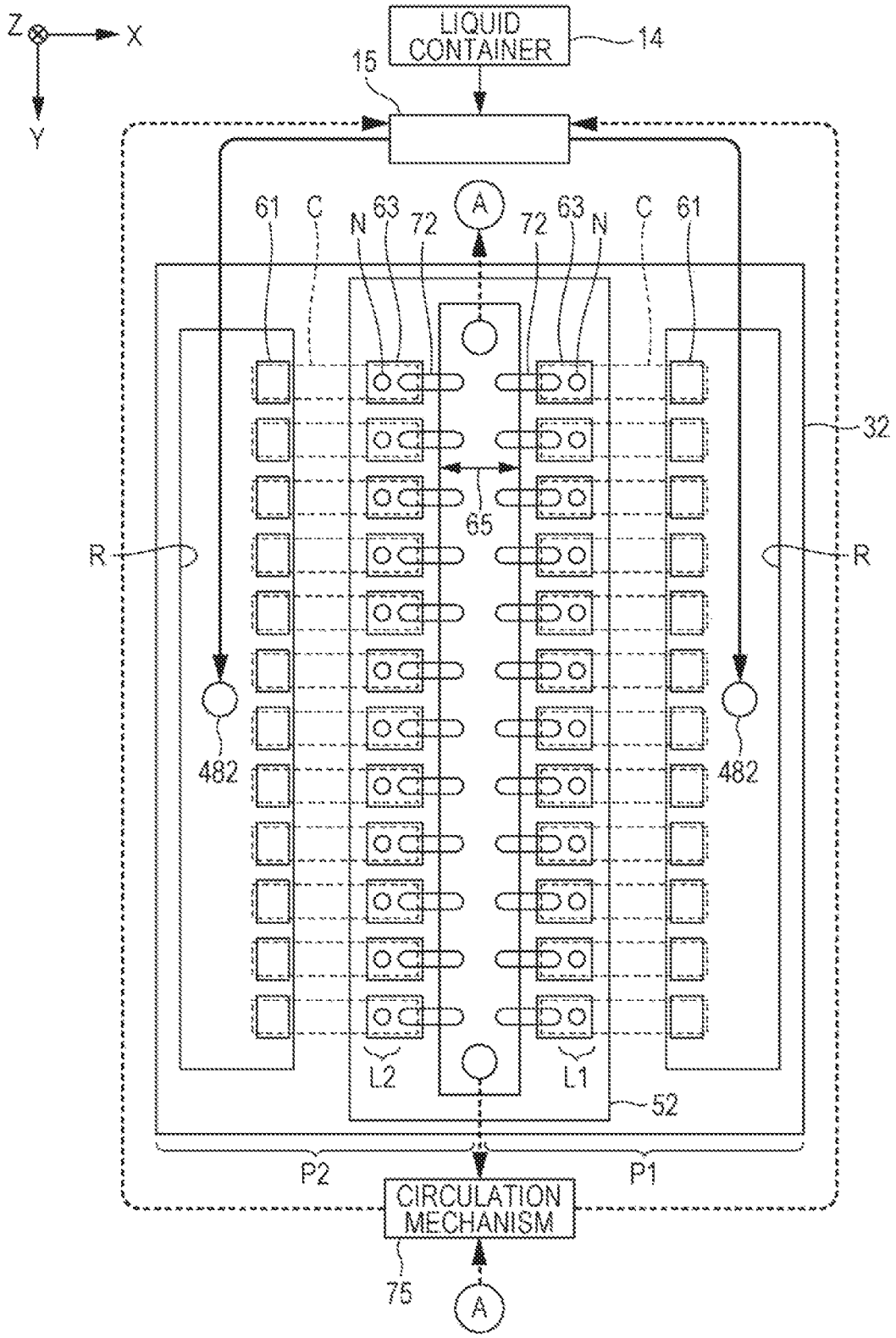
FIG. 5 is an explanatory diagram of an ink circulation in an ink jet head.

FIG. 5 is a configuration diagram of the ink jet head 26 focusing on the circulating liquid chamber 65. As illustrated in FIG. 5, the circulating liquid chamber 65 is continuous over the plurality of nozzles N along the first row L1 and the second row L2. Specifically, the circulating liquid chamber 65 is formed between the arrangement of the plurality of nozzles N in the first row L1 and the arrangement of the plurality of nozzles N in the second row L2. Therefore, as shown in FIG. 2, the circulating liquid chamber 65 is located between the communication path 63 of the first part P1 and the communication path 63 of the second part P2. As understood from the above description, the flow path forming portion 30 of the first embodiment is a structure in which the pressure chamber C (first pressure chamber) and the communication path 63 (first communication path) in the first part P1, the pressure chamber C (second pressure chamber) and the communication path 63 (second communication path) in the second part P2, and the circulating liquid chamber 65 located between the communication path 63 of the first part P1 and the communication path 63 of the second part P2 are formed. As illustrated in FIG. 2, the flow path forming portion 30 of the first embodiment includes a wall-shaped part (hereinafter, referred to as a "partition wall") 69 that partitions between the circulating liquid chamber 65 and each communication path 63.

As described above, the plurality of pressure chambers C and the plurality of piezoelectric elements 44 are arranged in the Y direction in each of the first part P1 and the second part P2. Therefore, it can be said that the circulating liquid chamber 65 extends in the Y direction so as to be continuous over the plurality of pressure chambers C or the plurality of piezoelectric elements 44 in each of the first part P1 and the second part P2. Further, as understood from FIGS. 2 and 3, it is possible that the circulating liquid chamber 65 and the liquid storage chamber R extend in the Y direction with a space and the pressure chamber C, the communication path 63, and the nozzle N are located within the space.

Figure 6:
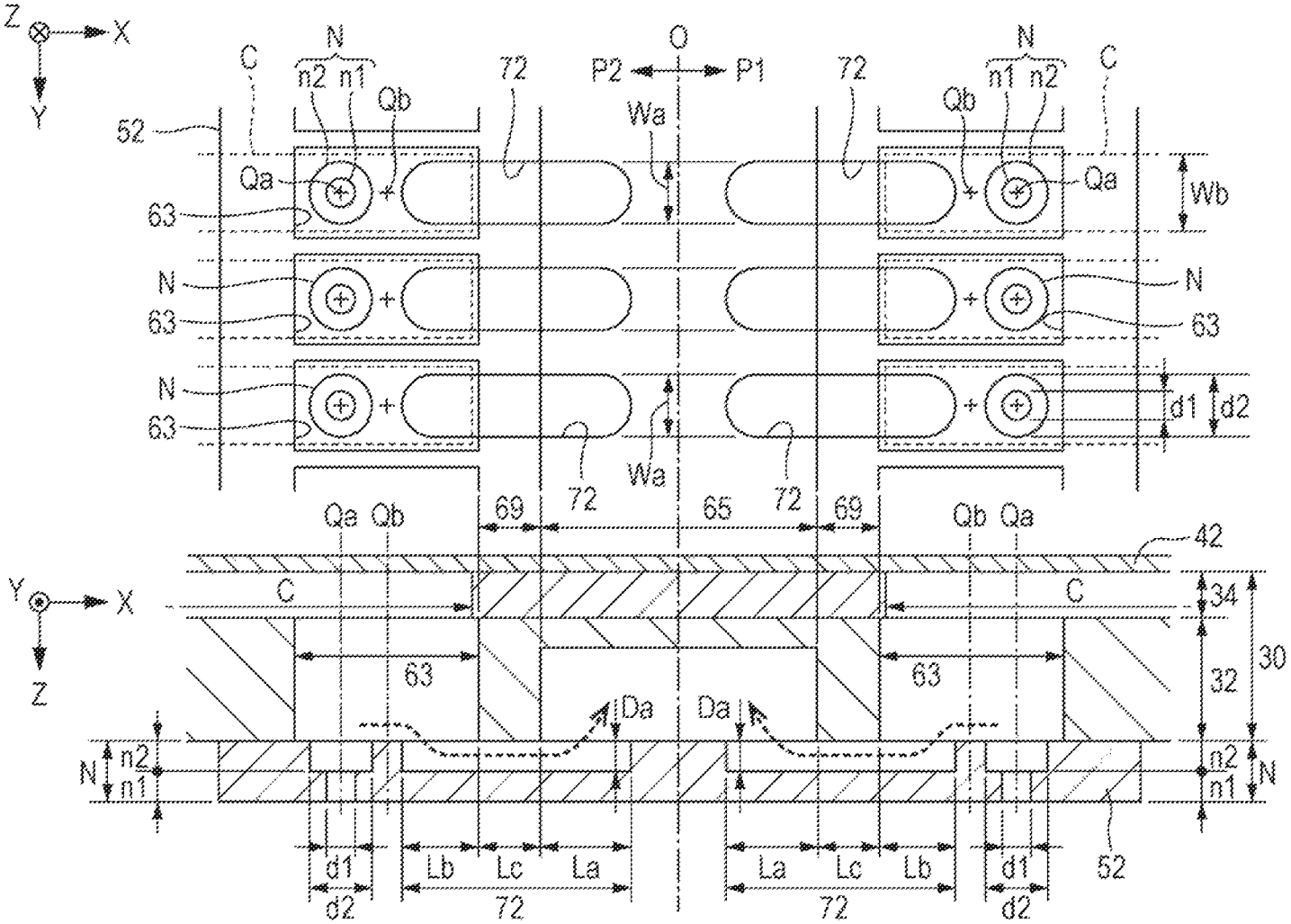
FIG. 6 is a plan diagram and a sectional diagram of a vicinity of a circulating liquid chamber in an ink jet head.

FIG. 6 is an enlarged plan diagram and a sectional diagram of a portion of the ink jet head 26 in the vicinity of the circulating liquid chamber 65. As shown in FIG. 6, one nozzle N in the first embodiment includes a first section n1 and a second section n2. The first section n1 and the second section n2 are circular spaces formed coaxially and communicating with each other. The second section n2 is located on the flow path forming portion 30 side as viewed from the first section n1. An inner diameter d2 of the second section n2 is larger than an inner diameter d1 of the first section n1 (d2>d1). As described above, according to the configuration in which each nozzle N is formed stepwise, there is an advantage that the flow path resistance of each nozzle N can be easily set to have desired characteristics. As shown in FIG. 6, a central axis Qa of each nozzle N in the first embodiment is located on the side opposite to the circulating liquid chamber 65 when viewed from a central axis Qb of the communication path 63.

As shown in FIG. 6, a plurality of circulation paths 72 are formed for each of the first part P1 and the second part P2 on the surface of the nozzle plate 52 facing the flow path forming portion 30. The plurality of circulation paths 72 (example of the first circulation path) of the first part P1 correspond to the plurality of nozzles N of the first row L1 (or the plurality of communication paths 63 corresponding to the first row L1) one to one. Further, the plurality of circulation paths 72 of the second part P2 (an example of the second circulation path) correspond to the plurality of nozzles N of the second row L2 (or the plurality of communication paths 63 corresponding to the second row L2) one to one.

Each circulation path 72 is a groove (that is, a long bottomed hole) extending in the X direction, and functions as a flow path for flowing through ink. The circulation path 72 of the first embodiment is formed at a position separated from the nozzle N (specifically, on the circulating liquid chamber 65 side when viewed from the nozzle N corresponding to the circulation path 72). For example, a plurality of nozzles N (particularly, the second section n2) and a plurality of circulation paths 72 are collectively formed in a common process by a semiconductor manufacturing technique (for example, a processing technique such as a dry etching and a wet etching).

As shown in FIG. 6, each circulation path 72 is formed linearly with a flow path width Wa equivalent to the inner diameter d2 of the second section n2 of the nozzle N. In addition, the flow path width (dimension in the Y direction) Wa of the circulation path 72 in the first embodiment is smaller than a flow path width (dimension in the Y direction) Wb of the pressure chamber C. Therefore, it is possible to increase the flow path resistance of the circulation path 72 as compared with a configuration in which the flow path width Wa of the circulation path 72 is larger than the flow path width Wb of the pressure chamber C. On the other hand, a depth Da of the circulation path 72 with respect to the surface of the nozzle plate 52 is constant over the entire length. Specifically, each circulation path 72 is formed at the same depth as the second section n2 of the nozzle N. According to the above configuration, there is an advantage that the circulation path 72 and the second section n2 are easily formed as compared with the configuration in which the circulation path 72 and the second section n2 are formed at different depths. The "depth" of the flow path means a depth of the flow path in the Z direction (for example, a height difference between a flow path forming surface and a flow path bottom surface).

Any one circulation path 72 in the first part P1 is located on the circulating liquid chamber 65 side in the first row L1 as viewed from the nozzle N corresponding to the circulation path 72. In addition, any one circulation path 72 in the second part P2 is located on the circulating liquid chamber 65 side in the second row L2 as viewed from the nozzle N corresponding to the circulation path 72. The end of each circulation path 72 on the side opposite to the center plane O (communication path 63 side) overlaps one communication path 63 corresponding to the circulation path 72 in plan view. That is, the circulation path 72 communicates with the communication path 63. On the other hand, an end of each circulation path 72 on the center plane O side (circulating liquid chamber 65 side) overlaps the circulating liquid chamber 65 in plan view. That is, the circulation path 72 communicates with the circulating liquid chamber 65. As understood from the above description, each of the plurality of communication paths 63 communicates with the circulating liquid chamber 65 via the circulation path 72. Accordingly, the ink in each communication path 63 is supplied to the circulating liquid chamber 65 via the circulation path 72 as shown by the dashed arrow in FIG. 6. That is, in the first embodiment, the plurality of communication paths 63 corresponding to the first row L1 and the plurality of communication paths 63 corresponding to the second row L2 commonly communicate with one circulating liquid chamber 65.

FIG. 6 shows a flow path length La of a portion of any one circulation path 72 overlapping the circulating liquid chamber 65, a flow path length (dimension in the X direction) Lb of a portion of the circulation path 72 overlapping the communication path 63, and a flow path length (dimension in the X direction) Lc of a portion of the circulation path 72 overlapping the partition wall 69 of the flow path forming portion 30. The flow path length Lc corresponds to a thickness of the partition wall 69. The partition wall 69 functions as a throttle portion of the circulation path 72. Therefore, as the flow path length Lc corresponding to the thickness of the partition wall 69 increases, the flow path resistance of the circulation path 72 increases. In the first embodiment, a relationship is established in which the flow path length La is longer than the flow path length Lb (La>Lb) and the flow path length La is longer than the flow path length Lc (La>Lc). Further, in the first embodiment, the relationship in which the flow path length Lb is longer than the flow path length Lc (Lb>Lc) is established (La>Lb>Lc). According to the above configuration, compared to the configuration in which the flow path length La and the flow path length Lb are shorter than the flow path length Lc, there is an advantage that the ink easily flows into the circulating liquid chamber 65 from the communication path 63 via the circulation path 72.

As exemplified above, in the first embodiment, the pressure chamber C communicates indirectly with the circulating liquid chamber 65 via the communication path 63 and the circulation path 72. That is, the pressure chamber C and the circulating liquid chamber 65 do not directly communicate with each other. In the above configuration, when the pressure in the pressure chamber C fluctuates due to the operation of the piezoelectric element 44, a part of the ink flowing through the communication path 63 is ejected from the nozzle N to the outside, and the remaining part of the ink flows from the communication path 63 into the circulating liquid chamber 65 via the circulation path 72. In the first embodiment, an inertance of the communication path 63, the nozzle, and the circulation path 72 is selected so that an amount of ink (hereinafter, referred to as "ejection amount") ejected through the nozzle N out of the ink flowing through the communication path 63 by one driving of the piezoelectric element 44 exceeds an amount of ink (hereinafter referred to as "circulation amount") flowing into the circulating liquid chamber 65 via the circulation path 72 out of the ink flowing through the communication path 63. Assuming that all the piezoelectric elements 44 are driven at the same time, it can also be said that a total circulation amount (for example, the flow rate in the circulating liquid chamber 65 within a unit time) that flows into the circulating liquid chamber 65 from the plurality of communication paths 63 is greater than a total ejection amount from the plurality of nozzles N.

Specifically, the flow path resistance of each of the communication path 63, the nozzle, and the circulation path 72 is determined so that the ratio of the circulation amount of the ink flowing through the communication path 63 is 70% or more (the ratio of ejection amount is 30% or less). According to the above configuration, it is possible to effectively circulate the ink composition in the vicinity of the nozzle to the circulating liquid chamber 65 while securing the ejection amount of ink. Schematically, there is a tendency that, as the flow path resistance of the circulation path 72 increases, the ejection amount increases while the circulation amount decreases, and as the flow path resistance of the circulation path 72 decreases, the ejection amount decreases while the circulation amount increases.

As illustrated in FIG. 5, the ink jet recording apparatus 100 according to the first embodiment includes a circulation mechanism 75. The circulation mechanism 75 is a mechanism for circulating the ink in the circulating liquid chamber 65. The circulation mechanism 75 of the first embodiment sends the ink in the circulating liquid chamber 65 to a sub-tank 15 and the ink is mixed with the ink supplied from the liquid container 14. Ink is stored inside the sub-tank 15. A gas-liquid interface between ink and air is formed in the sub-tank 15. Since the wax particles contained in the clear ink have a low density, the wax particles tend to float in the ink. When a gas-liquid interface between ink and air is generated at an air layer or at positions where air bubbles stay in the ink supply path or the head, and when the same ink stays without flowing, the wax becomes foreign substances at the gas-liquid interface. If the ink does not stay and flows, the foreign substances are unlikely to be generated. It is preferable to circulate the ink at the portion where the gas-liquid interface is generated to prevent the generation of the foreign substances. It is any part between the ink container and the head or inside the head. For example, air bubbles may adhere to and stay at the sub-tank 15, the self-sealing valve, the filter, the corner portion in the flow path, and the like. For this reason, it is preferable to circulate the ink as close as possible to the nozzle in the head. For example, it is a pressure chamber or a position downstream of the pressure chamber. Since the ink gradually moves during recording, the ink does not stay in one place and the same ink does not stay at the gas-liquid interface for a long period of time. However, during standby, the ink stays at the gas-liquid interface, so that the ink is likely to become foreign substances and needs to be circulated. In an example described later, in the example in which the filter clogging occurred without the circulation path, the generation of foreign substances was observed at the gas-liquid interface of the sub-tank 15, and it was found that the foreign substances flow some of the heads together with the ink and cause the clogging of the head filter. Further, small air bubbles were also generated in the self-sealing valve, and the generation of the foreign substances was also observed here.

The circulation mechanism 75 according to the first embodiment includes, for example, a suction mechanism (for example, a pump) that sucks ink from the circulating liquid chamber 65, a filter mechanism that collects air bubbles and foreign substances mixed in the ink, and a heating mechanism that reduces thickening by heating ink (not shown). The ink from which air bubbles and foreign substances have been removed by the circulation mechanism 75 and the viscosity of which has been reduced is supplied from the circulation mechanism 75 to the liquid storage chamber R via the inlet 482. As understood from the above description, in the first embodiment, ink circulates in the route of liquid storage chamber R→supply path 61→pressure chamber C→communication path 63→circulation path 72→circulating liquid chamber 65→circulation mechanism 75→sub-tank 15→inlet 482→liquid storage chamber R.

In the route, communication path 63→circulation path 72→circulating liquid chamber 65→circulation mechanism 75→sub-tank 15 corresponds to the circulation return path. The route is up to the junction with the ink flowing from the liquid container. In the circulation, the circulation of the ink through the circulation return path is particularly referred to as return.

In each of the above-described drawings, the ink supplied into the ink jet head is not discharged from the nozzle, passes through the circulation return path, is discharged to the outside of the ink jet head, and returns to the sub-tank. That is, it shows a circulation return path for returning the ink from the ink jet head. The ink returned to the sub-tank is supplied to the ink jet head again. In this case, the ink can be circulated inside the ink jet head and outside the ink jet head, and it is preferable because the suppression of the generation of the foreign substances in the ink is more excellent.

On the other hand, in FIG. 1, the ink that has flowed through the ink flow path from the sub-tank toward the ink jet head may be returned to the sub-tank in a manner that ink is not supplied into the ink jet head, is branched in the ink flow path in front of the ink jet head to form an ink flow path from the ink jet head toward the sub-tank. In this case, the flow path from a branch point to the sub-tank is the circulation return path. In other words, it is a circulation return path for returning the ink from the ink flow path that supplies the ink to the ink jet head. In this case, a circulation mechanism may be provided between the branch point and the sub-tank. Also, in this case, the ink can be circulated outside the ink jet head, and the suppression of the generation of the foreign substances in the ink is excellent.

In addition, when the ink jet recording apparatus has a circulation path for circulating the ink composition, the circulation path in FIG. 1 is a circulation path in a broad sense, which refers to the entire part that circulates ink, between the sub-tank and the ink jet head, or in the ink jet head. The circulation path 72 in FIG. 5 and the like is a circulation path in a narrow sense, which is a part of the circulation path in a broad sense.

Further, the sub-tank is not necessarily provided as a tank-shaped one, and it is sufficient as long as the sub-tank has a junction at which the ink returned from the circulation return path and the ink discharged from the liquid container can merge.

As understood from FIG. 5, the circulation mechanism 75 of the first embodiment sucks ink from both sides of the circulating liquid chamber 65 in the Y direction. That is, the circulation mechanism 75 sucks ink from the vicinity of the negative end of the circulating liquid chamber 65 in the Y direction and the vicinity of the positive end of the circulating liquid chamber 65 in the Y direction. In the configuration in which ink is sucked only from one end of the circulating liquid chamber 65 in the Y direction, a difference occurs in the pressure of ink between both ends of the circulating liquid chamber 65, and the pressure of ink in the communication path 63 may differ depending on the position in the Y direction due to the pressure difference in the circulating liquid chamber 65. Therefore, the ejection characteristics (for example, ejection amount and ejection speed) of the ink from each nozzle may be different depending on the position in the Y direction. In contrast to the above configuration, in the first embodiment, ink is sucked from both sides of the circulating liquid chamber 65, so that the pressure difference inside the circulating liquid chamber 65 is reduced. Therefore, the ink ejection characteristics can be approximated with high accuracy over a plurality of nozzles arranged in the Y direction. However, when the pressure difference in the Y direction in the circulating liquid chamber 65 does not cause any particular problem, a configuration in which ink is sucked from one end of the circulating liquid chamber 65 may be adopted.

As described above, the circulation path 72 and the communication path 63 overlap in plan view, and the communication path 63 and the pressure chamber C overlap in plan view. Therefore, the circulation path 72 and the pressure chamber C overlap each other in plan view. On the other hand, as understood from FIGS. 5 and 6, the circulating liquid chamber 65 and the pressure chamber C do not overlap each other in plan view. Further, since the piezoelectric element 44 is formed over the entire pressure chamber C along the X direction, the circulation path 72 and the piezoelectric element 44 overlap each other in a plan view, while the circulating liquid chamber 65 and the piezoelectric element 44 do not overlap each other in plan view. As understood from the above description, the pressure chamber C or the piezoelectric element 44 overlaps the circulation path 72 in plan view, but does not overlap the circulating liquid chamber 65 in plan view. Therefore, there is an advantage that the size of the ink jet head 26 is easily reduced as compared with a configuration in which the pressure chamber C or the piezoelectric element 44 does not overlap the circulation path 72 in plan view, for example.

As described above, in the first embodiment, the circulation path 72 for communicating the communication path 63 and the circulating liquid chamber 65 is formed in the nozzle plate 52. Therefore, the ink in the vicinity of the nozzle N can be efficiently circulated to the circulating liquid chamber 65. Further, in the first embodiment, the communication path 63 corresponding to the first row L1 and the communication path 63 corresponding to the second row L2 commonly communicate with the circulating liquid chamber 65 therebetween. Therefore, in comparison with a configuration in which a circulating liquid chamber communicating with each circulation path 72 corresponding to the first row L1 and a circulating liquid chamber communicating with each circulation path 72 corresponding to the second row L2 are separately provided, there is also an advantage that the configuration of the ink jet head 26 is simplified (and eventually downsized).

Second Embodiment

An ink jet recording apparatus according to a second embodiment will be described. Note that, in the following embodiments, for the elements having the same operations and functions as those of the first embodiment, the reference numerals used in the description of the first embodiment are used, and the detailed description thereof will be appropriately omitted.

Figure 7:
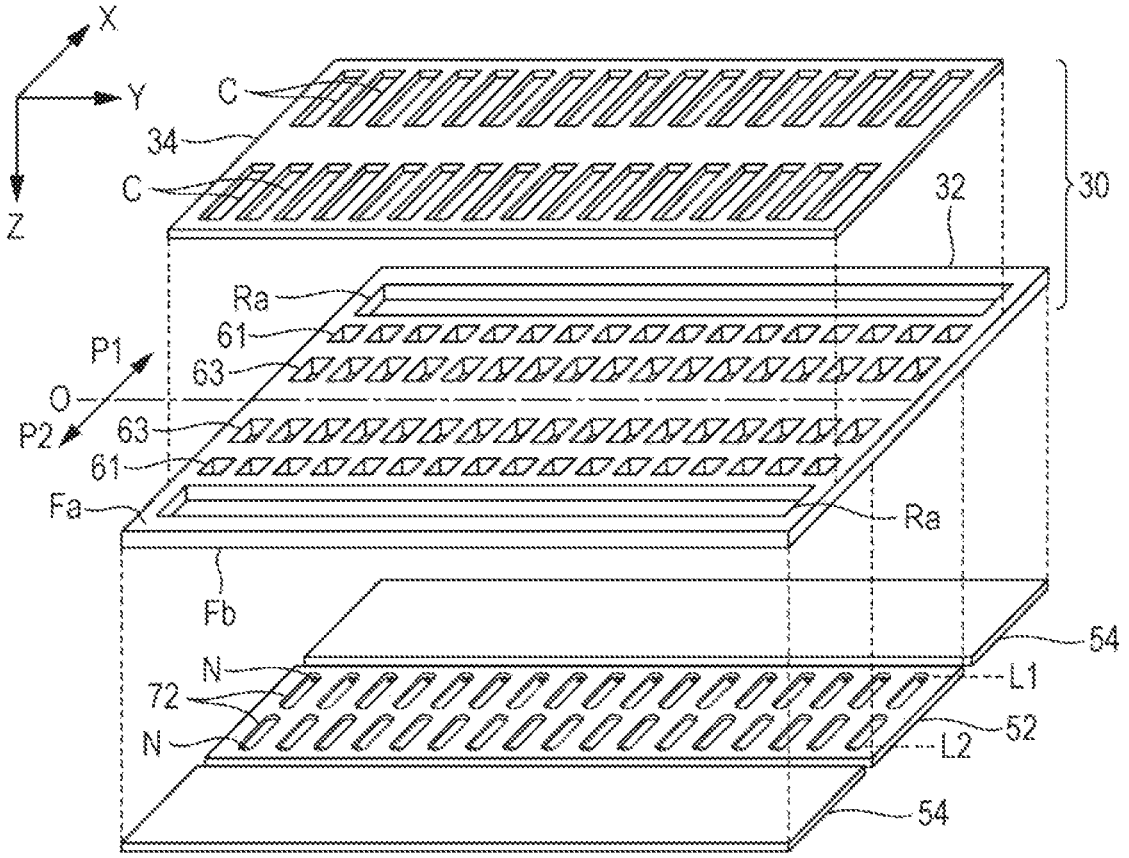
FIG. 7 is a partial exploded perspective diagram of an ink jet head according to a second embodiment.
Figure 8:
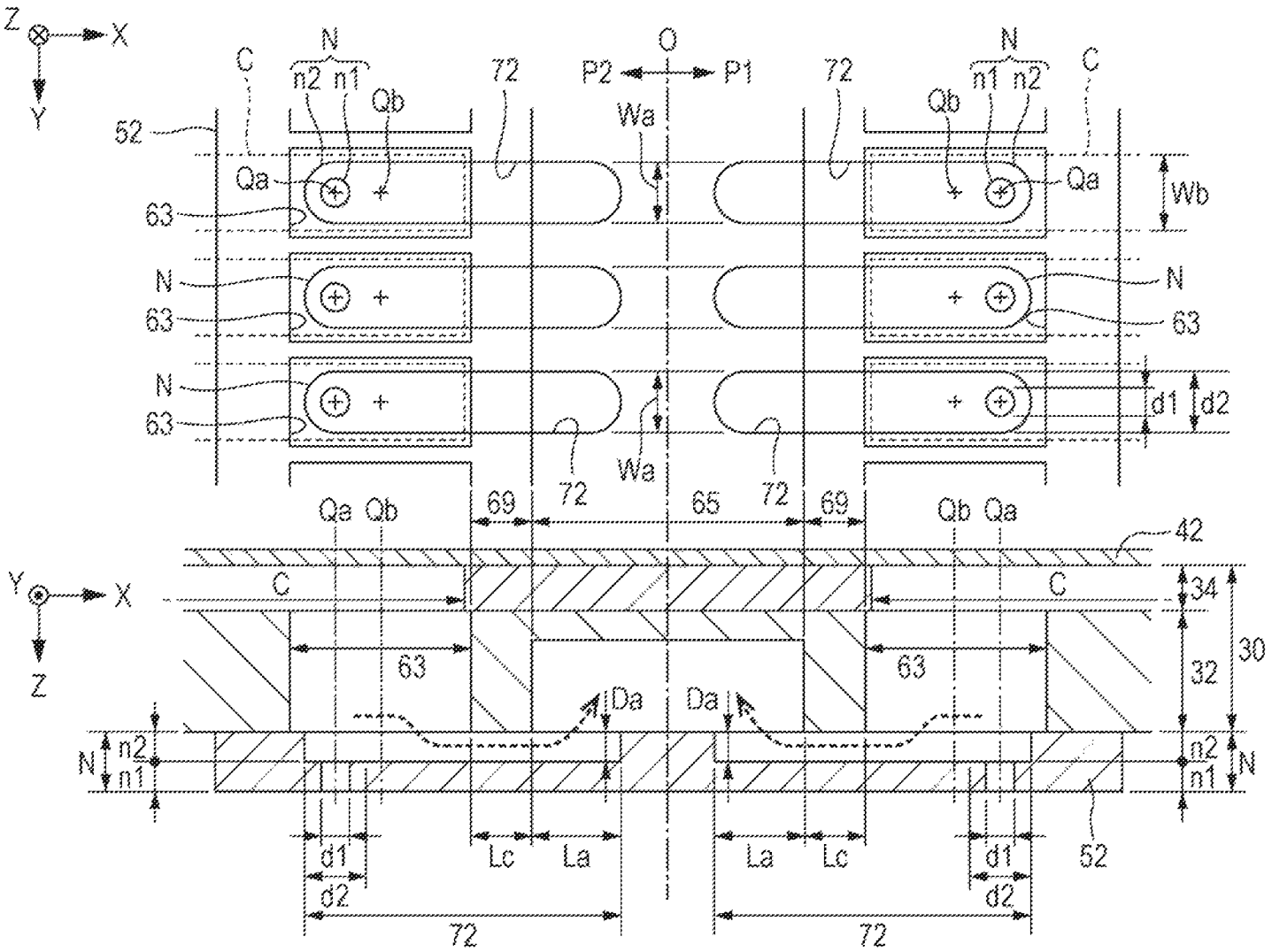
FIG. 8 is a plan diagram and a sectional diagram of a vicinity of a circulating liquid chamber according to a second embodiment.

FIG. 7 is a partial exploded perspective diagram of the ink jet head 26 according to the second embodiment, and corresponds to FIG. 3 referred to in the first embodiment. FIG. 8 is an enlarged plan diagram and a sectional diagram of a portion of the ink jet head 26 in the vicinity of the circulating liquid chamber 65, and corresponds to FIG. 6 referred to in the first embodiment.

In the first embodiment, a configuration in which the circulation path 72 and the nozzle N are separated from each other has been illustrated. In the second embodiment, as understood from FIGS. 7 and 8, the circulation path 72 and the nozzle N are continuous with each other. That is, one circulation path 72 of the first part P1 is continuous with one nozzle N of the first row L1, and one circulation path 72 of the second part P2 is continuous with one nozzle N of the second row L2. Specifically, as illustrated in FIG. 8, a second section n2 of each nozzle N is continuous with the circulation path 72. That is, the circulation path 72 and the second section n2 are formed at the same depth, and an inner peripheral surface of the circulation path 72 and an inner peripheral surface of the second section n2 are continuous with each other. In other words, the nozzle N (first section n1) is formed on the bottom surface of one circulation path 72 extending in the X direction. Specifically, the first section n1 of the nozzle N is formed in the vicinity of an end of the bottom surface of the circulation path 72 opposite to the center plane O. Other configurations are the same as those of the first embodiment. For example, also in the second embodiment, the flow path length La of the portion of the circulation path 72 overlapping the circulating liquid chamber 65 is longer than the flow path length Lc of the portion of the circulation path 72 overlapping the partition wall 69 of the flow path forming portion 30 (La>Lc).

In the second embodiment, the same effect as in the first embodiment is realized. In the second embodiment, the second section n2 of each nozzle N and the circulation path 72 are continuous with each other. Therefore, compared with the configuration of the first embodiment in which the circulation path 72 and the nozzle N are separated from each other, the effect of being able to efficiently circulate the ink in the vicinity of the nozzle N to the circulating liquid chamber 65 is extremely remarkable.

Third Embodiment

Figure 9:
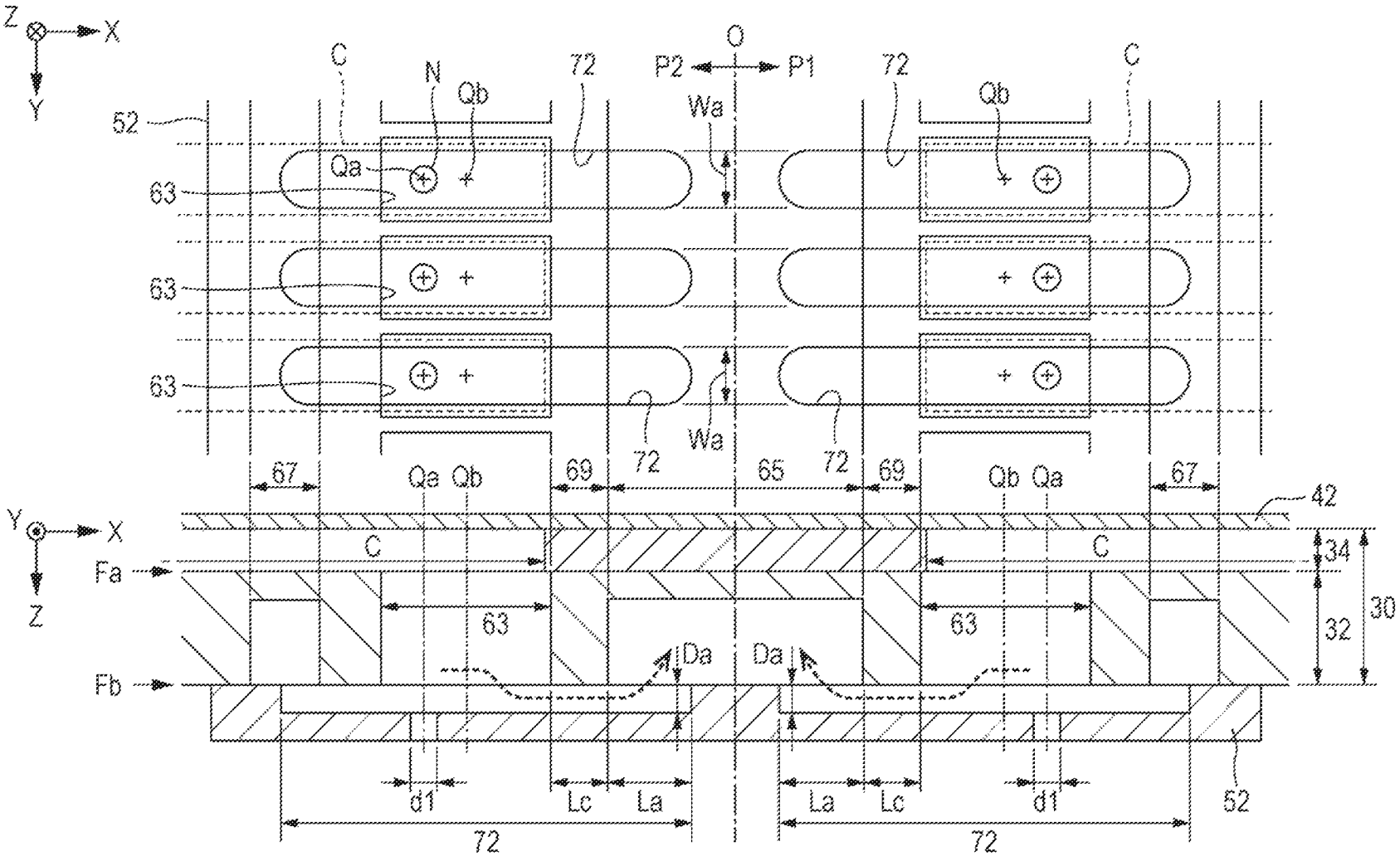
FIG. 9 is a plan diagram and a sectional diagram of a vicinity of a circulating liquid chamber in a third embodiment.

FIG. 9 is an enlarged plan diagram and a sectional diagram of a portion of the ink jet head 26 according to a third embodiment in the vicinity of the circulating liquid chamber 65. As shown in FIG. 9, the circulating liquid chambers 67 corresponding to each of the first part P1 and the second part P2 are formed on the surface Fb of the first flow path substrate 32 in the third embodiment, in addition to the circulating liquid chamber 65 similar to that in the above-described first embodiment. The circulating liquid chamber 67 is an elongated bottomed hole (groove) formed on the opposite side to the circulating liquid chamber 65 with the communication path 63 and the nozzle N interposed therebetween and extends in the Y direction. The openings of the circulating liquid chamber 65 and the circulating liquid chamber 67 are closed by the nozzle plate 52 joined to the surface Fb of the first flow path substrate 32.

The circulation path 72 of the third embodiment is a groove extending in the X direction so as to extend between the circulating liquid chamber 65 and the circulating liquid chamber 67 in each of the first part P1 and the second part P2. Specifically, the end of the circulation path 72 on the center plane O side (circulating liquid chamber 65 side) overlaps the circulating liquid chamber 65 in plan view, and the end of the circulation path 72 on the side opposite to the center plane O (circulating liquid chamber 67 side) overlaps the circulating liquid chamber 67 in plan view. The circulation path 72 overlaps the communication path 63 in plan view. That is, each communication path 63 communicates with both the circulating liquid chamber 65 and the circulating liquid chamber 67 via the circulation path 72.

A nozzle N (first section n1) is formed on the bottom surface of the circulation path 72. Specifically, a first section n1 of the nozzle N is formed on the bottom surface of a portion of the circulation path 72 overlapping the communication path 63 in plan view. Similarly to the second embodiment, in the third embodiment, it can also be expressed that the circulation path 72 and the nozzle N (second section n2) are continuous with each other. As understood from the above description, in the first embodiment and the second embodiment, the communication path 63 and the nozzle N are located at the end of the circulation path 72, whereas in the third embodiment, the communication path 63 and the nozzle N are located in the middle of the circulation path 72 extending in the X direction.

As understood from the above description, in the third embodiment, when the pressure in the pressure chamber C fluctuates, a part of the ink flowing in the communication path 63 is ejected from the nozzle N to the outside, and the remaining part is supplied from the communication path 63 to both the circulating liquid chamber 65 and the circulating liquid chamber 67 via the circulation path 72. The ink in the circulating liquid chamber 67 is sucked by the circulation mechanism 75 together with the ink in the circulating liquid chamber 65, and is supplied to the liquid storage chamber R after the air bubbles and foreign substances are removed and the viscosity is reduced by the circulation mechanism 75.

In the third embodiment, the same effect as in the first embodiment is realized. Further, in the third embodiment, since the circulating liquid chamber 67 is formed in addition to the circulating liquid chamber 65, there is an advantage that the circulation amount can be sufficiently ensured as compared with the first embodiment. Although FIG. 9 illustrates a configuration in which the circulation path 72 and the nozzle N are continuous as in the second embodiment, in the third embodiment, the circulation path 72 and the nozzle N can be separated from each other as in the first embodiment.

In the third embodiment, the circulating liquid chamber 65 may be omitted, and only two circulating liquid chambers 67 may be provided. That is, a configuration in which only circulating liquid chamber 67 corresponding to each of the first part P1 and the second part P2 is provided is possible. In a case of such a configuration, it is also possible to configure a circulation mechanism in which the ink circulating in the first part P1 and the ink circulating in the second part P2 are not mixed.

—Aqueous Clear Ink Composition—

An aqueous clear ink composition of the present embodiment (hereinafter, also simply referred to as "clear ink composition") contains wax particles. Here, the "aqueous ink composition" is an ink composition containing at least water as a main solvent of the ink. For example, it is an ink composition having a water content of 30% by mass or more based on the total mass of the ink composition. The content of water is preferably 50% by mass or more, and more preferably 60% by mass or more based on the total mass of the ink composition.

The "clear ink composition" is not a colored ink composition used for coloring a recording medium, but an auxiliary ink composition used for other purposes, such as obtaining the abrasion resistance and the glossiness of a recorded matter. In the clear ink composition, the content of the coloring material is preferably 0.10% by mass or less, more preferably 0.05% by mass or less, and may be 0% by mass based on the total amount (100% by mass) of the ink composition.

Wax Particles

The wax particles in the present embodiment are included in the clear ink composition in order to obtain excellent abrasion resistance of the recorded matter. However, since the wax particles have a low density, the wax particles easily float on the liquid surface of the clear ink composition, and when a gas-liquid interface is generated in the ink flow path and ink jet head, the wax particles float on the gas-liquid interface, and the gas-liquid interface foreign substances are easily generated. On the other hand, in the ink jet recording method of the present embodiment, the generation of the foreign substances is suppressed by circulating the clear ink composition. The wax particles are, for example, wax particles contained in an aqueous emulsion in which the wax is dispersed in water. The wax particles contain, for example, a wax and a surfactant A. The surfactant A is a surfactant for dispersing the wax.

Examples of the wax include, although not particularly limited, a hydrocarbon wax and an ester wax which is a condensate of fatty acid and monohydric alcohol or polyhydric alcohol. Examples of the hydrocarbon wax include, although not particularly limited, a paraffin wax and a polyolefin wax. One type of these waxes may be used alone, or two or more types may be used in combination. Among these waxes, the hydrocarbon wax is preferable, and the polyolefin wax is more preferable, from the viewpoint of improving the abrasion resistance. Examples of polyolefin include, although not particularly limited, polyethylene, polypropylene, and the like.

When the hydrocarbon wax is used, the abrasion resistance is further improved, but the dispersion stability of the wax particles is likely to be impaired, and foreign substances are likely to be generated. On the other hand, in the ink jet recording method of the present embodiment, the generation of the foreign substances is suppressed by circulating the clear ink composition.

Examples of commercially available paraffin wax include, AQUACER497 and AQUACER539 (product names, manufactured by BYK).

Examples of commercially available polyolefin wax include, Chemipearl 5120, 5650, and S75N (product names, manufactured by Mitsui Chemicals, Inc.), AQUACER501, AQUACER506, AQUACER513, AQUACER515, AQUACER526, AQUACER593, and AQUACER582 (product names, manufactured by BYK).

The number average molecular weight of the wax is preferably 10,000 or less, more preferably 8,000 or less, further preferably 6,000 or less, and further more preferably 4,000 or less. The number average molecular weight of the wax is preferably 1,000 or more.

The melting point of the wax is preferably 50° C. to 200° C., more preferably 70° C. to 180° C., further preferably 90° C. to 180° C.

The average particle diameter of the wax particles is preferably 30 nm to 500 nm, more preferably 35 nm to 300 nm, further preferably 40 nm to 120 nm, and particularly preferably 40 nm to 150 nm.

When the average particle diameter of the wax particles is within the above range, the abrasion resistance of the recorded matter can be further improved. However, in the clear ink composition, it is likely to aggregate and foreign substances are particularly likely to be generated. According to the ink jet recording method of the present embodiment, the generation of foreign substances can be suppressed by circulating the clear ink composition. The average particle diameter is based on volume unless otherwise specified. Examples of a measurement method include, a measurement method by a particle size distribution measuring device based on a laser diffraction scattering method as a measuring principle. Examples of the particle size distribution measuring device include, a particle size distribution meter based on a dynamic light scattering method (for example, Microtrac UPA, manufactured by Nikkiso Co., Ltd.) as a measuring principle.

The content of the wax particles is preferably 0.5% by mass or more, more preferably 1% by mass to 10% by mass, and further preferably 2% by mass to 4% by mass based on the total mass of the clear ink composition. When the wax content is within the above range, the abrasion resistance of the recorded matter can be further improved.

Further, the content of the wax in the clear ink composition is preferably greater than the content of the wax in the colored ink composition, more preferably 0.5% by mass or greater than the content of the wax in the colored ink composition, and further preferably 1% by mass or greater than the content of the wax in the colored ink composition. Although not particularly limited, it is preferable that the content of the wax in the clear ink composition is 10% by mass or less than the content of the wax in the colored ink composition.

The wax is preferably included in the ink as a dispersion (particle). As the wax dispersion, those having an anionic dispersibility, a nonionic dispersibility, or the like can be used. The nonionic dispersion is one in which the wax particles are nonionic and/or one in which the wax dispersion as a whole is nonionic due to the dispersion of the wax particles with a nonionic surfactant. Similarly, the anionic dispersion is one in which the wax particles are anionic and/or one in which the wax dispersion as a whole is anionic due to the dispersion of the wax particles with an anionic surfactant.

Of these, a wax dispersion having a nonionic dispersibility is preferable because it has more excellent abrasion resistance. On the other hand, although foreign substances tend to be generated easily, generation of foreign substances can be more suppressed by circulating the ink.

Surfactant A

Examples of the surfactant A used for dispersing the wax include, a nonionic surfactant, a cationic surfactant, an anionic surfactant, and an amphoteric surfactant. Among these, a nonionic surfactant is preferable. By using a nonionic surfactant, the abrasion resistance is further improved, but the dispersion stability of the wax particles is likely to be impaired, and foreign substances are likely to be generated. On the other hand, in the ink jet recording method of the present embodiment, the generation of the foreign substances is suppressed by circulating the clear ink composition.

Examples of the nonionic surfactant include, although not particularly limited, polyalkylene oxide ethers, higher aliphatic acid esters, and higher aliphatic amides.

Here, the "higher" means having 9 or more carbon atoms, preferably 9 to 30 carbon atoms, and more preferably 12 to 20 carbon atoms. Aliphatic means non-aromatic and includes chain aliphatic and cycloaliphatic. In a case of a chain aliphatic, a carbon-carbon double bond may be contained, but a triple bond is not contained.

Polyalkylene oxide ethers are substances having an ether bond in which an aliphatic group, an aryl group, or the like is bonded to the ether oxygen at the terminal of the polyalkylene oxide skeleton. The polyalkylene oxide is obtained by repeating the alkylene oxide. Examples of the polyalkylene oxide include a polyethylene oxide, a polypropylene oxide, and a combination thereof. In a case of a combined use, the arrangement order of them is not limited and may be random. An average number of added moles n of the alkylene oxide is not particularly limited, and is, for example, preferably 5 to 50, and more preferably 10 to 40. The aliphatic group of the polyalkylene oxide ethers is preferably a higher aliphatic group. "Higher" and "aliphatic" are as defined above. The aliphatic group may be branched or linear. The aryl group of the polyalkylene oxide ethers is not particularly limited, and includes, a polycyclic aryl group such as a phenyl group and a naphthyl group. The aliphatic group and the aryl group may be substituted with a functional group such as a hydroxyl group and an ester group. The polyalkylene oxide ethers may be compounds having a plurality of polyalkylene oxide chains in the molecule, and the number of polyalkylene oxide skeletons in the molecule is preferably 1 to 3.

Examples of the polyalkylene oxide ethers include, although not particularly limited, polyoxyethylene alkyl ether, polyoxyethylene alkyl phenyl ether, polyoxyethylene alkyl glucoside, polyoxyalkylene glycol alkyl ether, polyoxyalkylene glycol ether, and polyoxyalkylene glycol alkyl phenyl ether.

Higher aliphatic acid esters are esters of higher aliphatic acids. The "higher aliphatic" is as defined above, and may be substituted with, for example, a hydroxyl group or another functional group, or may have a branched structure. The structure of the alcohol residue of the higher aliphatic acid esters may be a cyclic or chain organic group, and preferably has 1 to 30 carbon atoms, more preferably 2 to 20 carbon atoms, and further preferably 3 to 10 carbon atoms. The higher aliphatic acid esters may be of a complex type having a polyalkylene oxide skeleton.

Examples of the higher aliphatic acid esters include, although not particularly limited, sucrose fatty acid ester, polyoxyethylene fatty acid ester, polyoxyethylene sorbitan fatty acid ester, sorbitan fatty acid ester, and polyoxyalkylene acetylene glycol.

Higher aliphatic amides are higher aliphatic amides. The "higher aliphatic" is as defined above, and may be substituted with, for example, a hydroxyl group or another functional group, or may have a branched structure. The higher aliphatic amines or amides may be of a complex type having a polyalkylene oxide skeleton.

Examples of the higher aliphatic amides include, although not particularly limited, aliphatic alkyl amide, fatty acid alkanolamide, and alkylol amide.

The nonionic surfactant is preferably a surfactant having an HLB value of 7 to 18.

Examples of commercially available nonionic surfactants include, Adecitol TN-40, TN-80, TN-100, LA-675B, LA-775, LA-875, LA-975, LA-1275, and OA-7 (product names, manufactured by ADEKA Corporation), CL-40, CL-50, CL-70, CL-85, CL-95, CL-100, CL-120, CL-140, CL-160, CL-200, and CL-400 (product names, manufactured by Sanyo Chemical Industries, Ltd.), Neugen XL-40, -41, -50, -60, -6190, -70, -80, -100, -140, -160, -160S, -400, -400D, and -1000, Neugen TDS-30, -50, -70, -80, -100, -120, -200D, and -500F, Neugen EA-137, -157, -167, -177, and -197D, DKS NL-30, -40, -50, -60, -70, -80, -90, -100, -110, -180, and -250, Neugen ET-89, -109, -129, -149, -159, and -189, Neugen ES-99D, -129D, -149D, and -169D, Sorgen TW-20, -60, -80V, and -80DK, ester F-160, -140, -110, -90, and -70 (product names, manufactured by Daiichi Kogyo Seiyaku Co., Ltd.), Latemul PD-450, PD-420, PD-430, and PD-430S, Rheodol TW-L106, TW-L120, TW-P120, TW-S106V, TW-S120V, TW-S320V, TW-0106V, TW-0120V, and TW-0320V, Odol 430V, 440V, and 460V, Rheodol Super SP-L10 and TW-L120, Emanone 1112, 3199V, 4110V, 3299RV, and 3299V, Emulgen 109P, 1020, 123P, 130K, 147, 150, 210P, 220, 306P, 320P, 350, 404, 408, 409PV, 420, 430, 1108, 1118S-70, 1135S-70, 1150S-60, 4085, A-60, A-90, A-500, and B-66 (product names, manufactured by Kao shares Co., Ltd.), and Sorbon T-20, Sorbon S-10E, and Pegnol 24-0 (product names, manufactured by Toho Chemical Industry Co., Ltd.).

Examples of the cationic surfactant include, although not particularly limited, primary, secondary, and tertiary amine salt-type compounds, alkylamine salt, dialkylamine salt, aliphatic amine salt, benzalkonium salt, quaternary ammonium salt, quaternary alkyl ammonium salt, alkylpyridinium salt, sulfonium salt, phosphonium salt, onium salt, and imidazolinium salt. Specific examples of the cationic surfactant include hydrochlorides such as laurylamine, cocoamine, and rosinamine, acetates, lauryltrimethylammonium chloride, cetyltrimethylammonium chloride, benzyltributylammonium chloride, benzalkonium chloride, dimethylethyllaurylammonium ethyl sulfate, dimethylethyloctyl ammonium ethyl sulfate, trimethyl lauryl ammonium hydrochloride, cetyl pyridinium chloride, cetyl pyridinium bromide, dihydroxyethyl lauryl amine, decyl dimethyl benzyl ammonium chloride, dodecyl dimethyl benzyl ammonium chloride, tetradecyl dimethyl ammonium chloride, hexa decyl dimethyl ammonium chloride, and octa decyl dimethyl ammonium chloride.

Examples of the anionic surfactant include, although not particularly limited, higher fatty acid salt, soaps, α-sulfofatty acid methyl ester salt, linear alkylbenzene sulfonate, alkyl sulfate ester salt, alkyl ether sulfate ester salt, monoalkyl phosphate ester salt, α-olefin sulfonate, alkylbenzene sulfonate, alkyl naphthalene sulfonate, naphthalene sulfonate, alkane sulfonate, polyoxyethylene alkyl ether sulfate, sulfosuccinate, and polyoxyalkylene glycol alkyl ether phosphate ester salt.

Examples of the amphoteric surfactant include, although not particularly limited, alkylamino fatty acid salt as amino acids, alkylcarboxyl betaine as betaines, and alkylamine oxide as amine oxides.

The molecular weight of the surfactant is preferably 10,000 or less, more preferably 7,000 or less, further preferably 5,000 or less, further more preferably 3,000 or less, and still more preferably 1,000 or less. Further, the molecular weight of the surfactant is preferably 100 or more, more preferably 200 or more, and further preferably 300 or more. The molecular weight of the surfactant can be obtained as a weight average molecular weight by performing measurement using a polystyrene as a standard polymer, by using a gel permeation chromatography (GPC) measuring device. In addition, those of which a chemical structural formula can be specified can be calculated.

The content of the surfactant A is preferably 10 parts by mass or less, more preferably 8 parts by mass or less, and further preferably 5 parts by mass or less based on 100 parts by mass of the wax. The content of the surfactant is 0 parts by mass or more, preferably 0.5 parts by mass or more, and more preferably 1 part by mass or more.

In the clear ink composition, the content of the surfactant A is preferably 1% by mass or less, more preferably 0.6% by mass or less, and further preferably 0.4% by mass or less based on the total mass of the clear ink composition. Further, the content is 0% by mass or more, preferably 0.05% by mass or more, more preferably 0.1% by mass or more, and further preferably 0.2% by mass or more.

Resin Particles

The clear ink composition used in the present embodiment preferably contains resin particles. When the clear ink composition contains the resin particles, it is possible to form a resin film when the recording medium to which the clear ink composition is adhered is heated. The resin particles are, for example, resin particles contained in an aqueous emulsion in which a resin is dispersed in water.

Examples of the resin include, although not particularly limited, a (meth) acrylic resin, a urethane resin, a polyether resin, and a polyester resin. Among these resins, an acrylic resin is preferable. The acrylic resin is a resin obtained by polymerizing at least an acrylic monomer as a component. The acrylic monomer includes a (meth) acrylic monomer. In the present specification, "(meth) acryl" is a concept including both "methacryl" and "acryl". The acrylic resin is also referred to as a (meth) acrylic resin.

The (meth) acrylic resin is not particularly limited, and examples thereof include an acrylic resin emulsion. Examples of the acrylic resin emulsion include, although not particularly limited, those obtained by polymerizing (meth) acrylic monomers such as (meth) acrylic acid and (meth) acrylic acid ester, and those obtained by copolymerizing a (meth) acrylic monomer and another monomer. In addition, the above-described copolymer may be in any form of a random copolymer, a block copolymer, an alternating copolymer, and a graft copolymer. Examples of commercially available acrylic resin emulsions include, Movinyl 966A, 972, and 8055A (product names, manufactured by Nippon Synthetic Chemical Industry Co., Ltd.), Microgel E-1002 and Microgel E-5002 (product names, manufactured by Nippon Paint Co., Ltd.), Boncoat 4001 and Boncoat 5454 (product names, manufactured by DIC Corporation), SAE1014 (product name, manufactured by Zeon Corporation), Cybinol SK-200 (product name, manufactured by Seiden Chemical Co., Ltd.), John Krill 7100, 390, 711, 511, 7001, 632, 741, 450, 840, 62J, 74J, HRC-1645J, 734, 852, 7600, 775, 537J, 1535, PDX-7630A, 352J, 352D, PDX-7145, 538J, 7640, 7641, 631, 790, 780, and 7610 (product names, manufactured by BASF), and NK Binder R-5HN (product name, manufactured by Shin-Nakamura Chemical Co., Ltd.). Among these resins, a (meth) acrylic resin or a styrene-(meth) acrylic acid copolymer resin is preferable, an acrylic resin or a styrene-acrylic acid copolymer resin is more preferable, and a styrene-acrylic acid copolymer resin is further preferable.

Examples of the urethane resin include a urethane resin emulsion. Examples of the urethane resin emulsion include, although not particularly limited, a polyether type urethane resin containing an ether bond in the main chain, a polyester type urethane resin containing an ester bond in the main chain, and a polycarbonate type urethane resin containing a carbonate bond in the main chain. Examples of commercially available urethane resin emulsion include, Suncure 2710 (product name, manufactured by Nippon Lubrisol Co., Ltd.), Permarin UA-150 (product name, manufactured by Sanyo Chemical Industry Co., Ltd.), Superflex 460, 470, 610, 700, and 860 (product names, manufactured by Daiichi Kogyo Seiyaku Co., Ltd.), NeoRez R-9660, R-9637, and R-940 (product names, manufactured by Kusumoto Kasei Co., Ltd.), Adecabon Titer HUX-380, 290K (product name, manufactured by ADEKA corporation), Takerak W-605, W-635, and WS-6021 (product names, manufactured by Mitsui Chemicals, Inc.), and polyether (manufactured by Taisei Fine Chemical Co., Ltd.).

Examples of a polyester-based resin include, although not specifically limited, polybutylene terephthalate, polytrimethylene terephthalate, polyethylene terephthalate, and polyethylene naphthalate. The polyester-based resin may be a sulfopolyester resin (polysulfoester resin) substituted with a sulfo group (sulfonic acid group).

The glass transition temperature (Tg) of the resin is preferably −35° C. or higher, more preferably 0° C. or higher, further preferably 20° C. or higher, further more preferably 35° C. or higher, and still more preferably 40° C. or higher. Further, the glass transition temperature of the resin is preferably 70° C. or lower and more preferably 60° C. or lower. The glass transition temperature can be changed by, for example, changing at least one of the kind and composition ratio of the monomers used for polymerizing the resin, the polymerization conditions, and the modification of the resin. For example, the glass transition temperature can be adjusted by reducing the number of polymerizable functional groups, lowering the crosslink density of the resin, or using a monomer having a relatively large molecular weight (a monomer having a large number of carbon atoms). Examples of the polymerization conditions include, a temperature at the time of polymerization, a type of a medium containing a monomer, a monomer concentration in the medium, and types and use amounts of a polymerization initiator and a catalyst used at the time of polymerization. The glass transition temperature of the resin can be measured by a differential scanning calorimetry (DSC method) based on JIS K7121.

The content of the resin particles is preferably 500 parts by mass or less, more preferably 400 parts by mass or less, and further preferably 300 parts by mass or less, based on 100 parts by mass of the wax. The content of the resin particles is 0 parts by mass or more, preferably 50 parts by mass or more, and more preferably 100 parts by mass or more.

In the clear ink composition, the content of the resin particles is preferably 20% by mass or less, more preferably 15% by mass or less, and further preferably 10% by mass or less, based on the total mass of the clear ink composition. Further, the content is 0% by mass or more, preferably 1.0% by mass or more, more preferably 2.0% by mass or more, and further preferably 3.0% by mass or more.

Defoaming Agent

The clear ink composition may contain a defoaming agent such as an acetylene glycol-based defoaming agent. The acetylene glycol-based defoaming agent is not particularly limited, and, for example, one or more selected from, alkylene oxide adducts of 2,4,7,9-tetramethyl-5-decyne-4,7-diol and 2,4,7,9-tetramethyl-5-decyne-4,7-diol, and alkylene oxide adducts of 2,4-dimethyl-5-decyn-4-ol and 2,4-dimethyl-5-decyn-4-ol are preferable. Examples of commercially available acetylene glycol-based defoaming agent include, although not particularly limited, Olfin 104 series and Olfin E series including E1010 or the like (product names, manufactured by Air Products), and Surfynol 465, 61, and DF110D (product names, manufactured by Nissin Chemical Industry Co., Ltd.).

In the clear ink composition, the content of the defoaming agent is preferably 10.0% by mass or less, more preferably 5.0% by mass or less, and further preferably 1.0% by mass or less based on the total mass of the clear ink composition. Further, the content is 0% by mass or more, preferably 0.1% by mass or more, and more preferably 0.2% by mass or more.

Water

The clear ink composition according to the present embodiment contains water. Examples of the water include, although not particularly limited, pure water such as ion exchange water, ultrafiltration water, reverse osmosis water, and distilled water, and ultrapure water.

In the clear ink composition, the content of water is preferably 10.0% by mass or more, more preferably 10.0% by mass to 80.0% by mass, further preferably 15.0% by mass to 75.0% by mass, further more preferably 20.0% by mass to 70.0% by mass based on the total amount of the clear ink composition.

Water-Soluble Organic Solvent

The clear ink composition of the present embodiment may further contain a water-soluble organic solvent from the viewpoint of viscosity adjustment and moisturizing effect.

Examples of the water-soluble organic solvent include, although not particularly limited, glycerin, lower alcohols, glycols, acetins, derivatives of glycols, nitrogen-containing solvents, β-thiodiglycol, and sulfolane. Among them, from the viewpoint of further improving the abrasion resistance, it is preferable to contain a nitrogen-containing solvent or glycols, more preferable to include glycols, and further preferable to include a nitrogen-containing solvent and glycols.

The clear ink composition preferably contains a nitrogen-based solvent. As the nitrogen-containing solvent, any solvent having a nitrogen atom in the molecule may be used. For example, an amide-based solvent can be exemplified. Examples of the amide-based solvent include cyclic amides and acyclic amides. Examples of the cyclic amides include, although not particularly limited, 2-pyrrolidone, N-alkyl-2-pyrrolidone, 1-alkyl-2-pyrrolidone, and ε-caprolactam. These pyrrolidones can be exemplified.

Examples of the acyclic amides include N,N-dialkylpropanamides, and particularly, 3-alkoxy-N,N-dialkylpropanamide. For example, 3-methoxy-N,N-dimethylpropanamide, 3-butoxy-N,N-dimethylpropanamide, and the like can be exemplified.

The content of the nitrogen-containing solvent is preferably 1% by mass or more, more preferably 5% by mass or more, further preferably 10% by mass or more, based on the total content of the water-soluble organic solvent. Further, the content of the nitrogen-containing solvent is preferably 50% by mass or less, more preferably 40% by mass or less, and further preferably 30% by mass or less, based on the total content of the water-soluble organic solvent.

In the clear ink composition, the content of the nitrogen-containing solvent is preferably 1% by mass or more, more preferably 2% by mass or more, and further preferably 3% by mass or more, based on the total mass of the clear ink composition. Further, the content of the nitrogen-containing solvent is preferably 20% by mass or less, more preferably 15% by mass or less, and further preferably 10% by mass or less, based on the total mass of the clear ink composition.

Examples of the glycols include, although not particularly limited, alkane diols having 4 or less carbon atoms, and condensates of alkane diols having 4 or less carbon atoms condensed between hydroxyl groups between molecules. In a case of the condensate, the number of condensation is preferably 2 to 5. Examples of the glycols include, although not particularly limited, ethylene glycol, diethylene glycol, triethylene glycol, tetraethylene glycol, pentaethylene glycol, propylene glycol, dipropylene glycol, and tripropylene glycol.

The content of glycols is preferably 50% by mass or more, more preferably 60% by mass or more, and further preferably 70% by mass or more, based on the total content of the water-soluble organic solvent. The content of glycols is 100% by mass or less, and more preferably 90% by mass or less, based on the total content of the water-soluble organic solvent.

In the clear ink composition, the content of glycols is preferably 1% by mass or more, more preferably 5% by mass or more, and further preferably 10% by mass or more, based on the total mass of the clear ink composition. Further, the content of the glycols is preferably 50% by mass or less, more preferably 40% by mass or less, and further preferably 30% by mass or less, based on the total mass of the clear ink composition.

Examples of the lower alcohols include, although not particularly limited, methanol, ethanol, 1-propanol, isopropanol, 1-butanol, 2-butanol, isobutanol, 2-methyl-2-propanol, and 1,2-hexanediol.

Examples of the acetins include, although not particularly limited, monoacetin, diacetin, and triacetin.

Examples of the derivative of glycols include, although not particularly limited, etherified products of glycols. Examples of the derivative of glycols include, although not particularly limited, triethylene glycol monomethyl ether, triethylene glycol monoethyl ether, triethylene glycol monopropyl ether, triethylene glycol monobutyl ether, tetraethylene glycol monomethyl ether, tetraethylene glycol monoethyl ether, tetraethylene glycol dimethyl ether, and tetraethylene glycol diethyl ether. These water-soluble organic solvents may be used alone or in combination of two or more thereof.

Among these water-soluble organic solvents, glycerin and lower alcohols are preferable, and glycerin and 1,2-hexanediol are more preferable.

When the clear ink composition contains a water-soluble organic solvent, the content is preferably 1.0% by mass to 50.0% by mass, more preferably 5.0% by mass to 40.0% by mass, further preferably 10.0% by mass to 30.0% by mass, based on the total amount of the clear ink composition.

The water-soluble organic solvent preferably has a standard boiling point of 150° C. to 280° C. In the ink composition, the content of the water-soluble organic solvent having a standard boiling point exceeding 280° C. is preferably 2% by mass or less, more preferably 1% by mass or less, further preferably 0.5% by mass or less, and may be 0% by mass.

Surfactant B

The clear ink composition of the present embodiment preferably further contains a surfactant B from the viewpoint that the ink composition can be stably discharged by an ink jet recording method and that the penetration of the ink composition can be appropriately controlled. Examples of the surfactant B include, although not particularly limited, a fluorine-based surfactant, an acetylene glycol-based surfactant, and a silicone-based surfactant. Nonionic surfactants are preferred.

Examples of the fluorine-based surfactant include, although not particularly limited, a perfluoroalkyl sulfonate, a perfluoroalkyl carboxylate, a perfluoroalkyl phosphate ester, a perfluoroalkyl ethylene oxide adduct, a perfluoroalkyl betaine, and a perfluoroalkylamine oxide compound. These may be used alone or in combination of two or more thereof. Examples of commercially available fluorine-based surfactant include, Surflon 5144 and 5145 (product names, manufactured by AGC Seimi Chemical Co., Ltd.), FC-170C, FC-430, and Florard-FC4430 (product names, manufactured by Sumitomo 3M Limited), FSO, FSO-100, FSN, FSN-100, and FS-300 (product names, manufactured by Dupont), and FT-250 and 251 (product names, manufactured by Neos Co., Ltd.).

Examples of the silicone-based surfactant include, although not particularly limited, a polysiloxane-based compound and a polyether modified organosiloxane. These may be used alone or in combination of two or more thereof. Examples of commercially available silicone-based surfactant include, BYK-306, BYK-307, BYK-333, BYK-341, BYK-345, BYK-346, BYK-347, BYK-348, and BYK-349 (product names, manufactured by BYK), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (product names, manufactured by Shin-Etsu Chemical Co., Ltd.).

Examples of the acetylene glycol-based surfactant include those in which an acetylene compound has two hydroxyl groups. Examples of the acetylene compound include acetylene and those obtained by modifying acetylene with a polyoxyalkylene chain. Hydroxyl groups can be included in acetylene, polyoxyalkylene chains, and the like.

When the clear ink composition contains a surfactant, the content thereof is preferably 0.1% by mass to 5.0% by mass, more preferably 0.2% by mass to 3.0% by mass, and further preferably 0.2% by mass to 1.0% by mass, based on the total amount of the clear ink composition.

The clear ink composition may appropriately contain various additives, as other additives, such as a pH adjuster, a softener, a wax, a dissolution aid, a viscosity adjuster, an antioxidant, a fungicide/antiseptic, a fungicide, a corrosion inhibitor, and a chelating agent for trapping metal ions affecting dispersion (for example, sodium ethylenediaminetetraacetate).

The solid content concentration in the clear ink composition is preferably 3.0% by mass or more, more preferably 5.0% by mass or more, and further preferably 8.0% by mass or more. The solid content concentration is preferably 30.0% by mass or less, more preferably 25.0% by mass or less, and further preferably 20.0% by mass or less.

In the present embodiment, the clear ink composition is obtained by mixing the above-described components in an optional order, and performing filtration or the like as necessary to remove impurities. As a mixing method of each component, a method of sequentially adding materials to a container equipped with a stirrer such as a mechanical stirrer and a magnetic stirrer and stirring and mixing them is preferably used. As a filtration method, centrifugal filtration, filter filtration, or the like can be performed as necessary.

—Aqueous Colored Ink Composition—

The aqueous colored ink composition of the present embodiment (hereinafter, also simply referred to as "colored ink composition") contains a coloring material. The colored ink composition is ink used for coloring a recording medium.

The coloring material may be a pigment or a dye.

The pigment may be an organic pigment or an inorganic pigment. Examples of the organic pigment include, although not particularly limited, azo pigments such as azo lake pigments, insoluble azo pigments, condensed azo pigments, and chelate azo pigments, polycyclic pigments such as phthalocyanine pigments, perylene pigments, perinone pigments, anthraquinone pigments, quinacridone pigments, dioxazine pigments, thioindigo pigments, isoindolinone pigments, isoindoline pigments, quinophthalone pigments, and diketopyrrolopyrrole pigments, dye lake pigments such as basic dye type lakes and acid dye type lakes, nitro pigments, nitroso pigments, aniline black, and daylight fluorescent pigments. Examples of the inorganic pigment include, although not particularly limited, metal oxide pigments such as titanium dioxide, zinc oxide, and chromium oxide, and carbon black.

Examples of the pigment include, although not particularly limited, C. I. (Colour Index Generic Name) Pigment Yellow 1, 3, 12, 13, 14, 17, 24, 34, 35, 37, 42, 53, 55, 74, 81, 83, 95, 97, 98, 100, 101, 104, 108, 109, 110, 117, 120, 138, 153, 155, and 180, C. I. Pigment Red 1, 2, 3, 5, 17, 22, 23, 31, 38, 48:2 (permanent red 2B (Ba)), 48:2 (permanent red 2B (Ca)), 48:3, 48:4, 49:1, 52:2, 53:1, 57:1, 60:1, 63:1, 63:2, 64:1, 81, 83, 88, 101, 104, 105, 106, 108, 112, 114, 122, 123, 146, 149, 166, 168, 170, 172, 177, 178, 179, 185, 190, 193, 209, and 219, C. I. Pigment Violet 19 and 23, C. I. Pigment Blue 1, 2, 15, 15:1, 15:2, 15:3, 15:4, 15:6, 16, 17:1, 56, 60, and 63, and C. I. Pigment Green 1, 4, 7, 8, 10, 17, 18, and 36.

Examples of the pigment for black color include, although not particularly limited, C. I. Pigment Black 1, 7 (carbon black), and 11.

Examples of the white pigment for white color include, although not particularly limited, C. I. Pigment White 1, which is basic lead carbonate, C. I. Pigment White 4 consisting of zinc oxide, C. I Pigment White 5 consisting of a mixture of zinc sulfide and barium sulfate, C. I. Pigment White 6 consisting of titanium oxide, C. I. Pigment White 6:1 consisting of titanium oxide containing other metal oxides, C. I. Pigment White 7 consisting of zinc sulfide, C. I. Pigment White 18 consisting of calcium carbonate, C. I. Pigment White 19 consisting of clay, C. I. Pigment White 20 consisting of mica titanium, C. I. Pigment White 21 consisting of barium sulfate, C. I. Pigment White 22 consisting of gypsum, C. I. Pigment White 26 consisting of magnesium oxide/silicon dioxide, C. I. Pigment White 27 consisting of silicon dioxide, and C. I. Pigment White 28 consisting of anhydrous calcium silicate. Among these, titanium oxide (C. I. Pigment White 6) is preferable because of its excellent color developing properties and hiding properties.

In addition to these coloring pigments, glitter pigments such as pearl pigments and metallic pigments may be used. In order to enhance the dispersibility of the pigment in the ink composition, the pigment may be subjected to a surface treatment. The surface treatment of the pigment is a method of introducing a functional group having an affinity for a medium of the ink composition to the surface of the pigment particle by physical treatment or chemical treatment. For example, when it is used in an aqueous ink composition described later, it is preferable to introduce a hydrophilic group such as a carboxy group and a sulfo group. In addition, these pigments may be used alone or in combination of two or more thereof.

The content of the coloring material is preferably 0.1% by mass to 30.0% by mass, more preferably from 0.5% by mass to 20.0% by mass, further preferably 1.0% by mass to 15.0% by mass, further more preferably 1.5% by mass to 10.0% by mass, and particularly preferably 2.0% by mass to 5.0% by mass, based on the total mass of the colored ink composition. Further, the content of the coloring material is preferably 8.0% by mass to 14.0% by mass based on the total mass of the colored ink composition. By setting the pigment content within the range described-above, it is possible to ensure color development of an image or the like formed on a recording medium or the like, and to suppress an increase in the viscosity of the ink jet ink and the occurrence of clogging in the ink jet head.

The colored ink composition may contain a water-soluble organic solvent, the above-described surfactant B, a defoaming agent, resin particles, or other additives. The illustration and content of these components are the same as the clear ink composition described-above. Further, the colored ink composition may appropriately contain various additives, as other components, such as, a dissolution aid, a viscosity adjuster, a pH adjuster, an antioxidant, an antiseptic, a fungicide, a corrosion inhibitor, and a chelating agent for trapping metal ions affecting dispersion.

The colored ink composition may or may not contain a wax. The colored ink composition has a wax content of preferably 1.0% by mass or less, more preferably 0.5% by mass or less, further preferably 0.3% by mass or less, and the wax content may be 0% by mass.

Ink Jet Recording Method

In the ink jet recording method according to the present embodiment, the above-described ink jet recording apparatus is used. The ink jet recording method according to the present embodiment includes, a colored ink adhesion step of discharging the above-described colored ink composition from an ink jet head and adhering it to a recording medium (hereinafter, also simply referred to as "colored ink adhesion step") and a clear ink adhesion step of discharging the above-described clear ink composition from an ink jet head and adhering it to a recording medium (hereinafter, also simply referred to as "clear ink adhesion step"). In the clear ink adhesion step, the clear ink composition circulated through the circulation path is discharged.

Note that, these steps in the recording method may be performed simultaneously or in any order, and preferably performed in the order of the colored ink adhesion step and the clear ink adhesion step.

—Colored Ink Adhesion Step—

In the colored ink adhesion step, the above-described colored ink composition is discharged from an ink jet head and adhered to a recording medium.

Recording Medium

The recording medium is not particularly limited. For example, any of an absorptive and a non-absorptive recording medium may be used, and the recording medium is preferably a low-absorptive recording medium or a non-absorptive recording medium.

The "absorptive recording medium" in the present specification means a recording medium having a property of absorbing the ink composition. "A low-absorptive recording medium or a non-absorptive recording medium" means a recording medium having a property of absorbing no or almost no ink composition. Quantitatively, the "low-absorptive recording medium or non-absorptive recording medium" is a recording medium in which the water absorption from the start of contact to 30 $msec^{1/2}$ in the Bristow method is 10 $mL/m^2$ or less. The "absorptive recording medium" is a recording medium in which the water absorption exceeds 10 $mL/m^2$. For details of the Bristow method, refer to the description of Standard No. 51 "Paper and Paperboard-Liquid Absorption Test Method—Bristow Method" of "JAPAN TAPPI Paper Pulp Test Method 2000 Edition".

Examples of the non-absorptive recording medium include, although not particularly limited, films or plates of plastics such as polyvinyl chloride (hereinafter, also referred to as "PVC"), polyethylene, polypropylene, polyethylene terephthalate, plates of metals such as iron, silver, copper, and aluminum, or metal plates or plastic films produced by vapor deposition of these various metals, and alloy plates including stainless steel, brass, and the like.

Examples of the low-absorptive recording medium include coated paper that can be used for analog printing and the like. The coated paper is printing paper provided with a coating layer having a low ink absorbency on the surface.

In the colored ink adhesion step, preferably, the colored ink composition circulated in the circulation path is discharged. By circulating the colored ink composition, the aggregation of the components in the colored ink composition is prevented, and the generation of foreign substances is suppressed. The circulation amount (circulation speed) of the colored ink composition in the circulation return path is preferably 0.5 g/min or more per one ink jet head. Further, the circulation amount (circulation speed) is preferably 12 g/min or less per one ink jet head. Further, the circulation amount (circulation speed) is preferably 0.5 g/min to 12 g/min, more preferably 1 g/min to 9 g/min, and further preferably 2 g/min to 5 g/min per one ink jet head. Here, the one ink jet head is assumed to be a unit in which a group of nozzles capable of discharging ink introduced from one ink inlet is integrated, and corresponds to the amount of ink returned from the group of nozzles that are integrated together.

The circulation of the colored ink may be performed during recording or may be performed during standby described later. The components such as pigments contained in the colored ink tend to decrease the discharge stability when the colored ink dries at the nozzle, and it is preferable to circulate the components during recording.

—Clear Ink Adhesion Step—

In the clear ink adhesion step, the above-described clear ink composition is discharged from an ink jet head and adhered to a recording medium. In the clear ink adhesion step, the recording medium is preferably a recording medium to which the colored ink has been adhered through the above-described colored ink adhesion step. The wax can improve the abrasion resistance of the recorded matter by improving the slippage of the surface of the recorded matter. In the clear ink adhesion step, it is preferable to adhere the clear ink as an overcoat covering the surface to which the colored ink has been adhered.

In the clear ink adhesion step, the clear ink composition circulated in the circulation path is discharged. The present inventors have found that even in the clear ink composition, foreign substances are generated due to the aggregation or the like of the components. Therefore, by circulating the clear ink composition through the circulation path, the discharge stability of the ink can be improved. The circulation amount of the clear ink composition in the circulation return path can be an amount in the range the same as that of the circulation amount of the colored ink composition in the circulation return path. However, the circulation amount of the clear ink composition in the circulation return path can be independent of the circulation amount of the colored ink composition in the circulation return path.

In the clear ink adhesion step of discharging the clear ink composition circulated in the circulation path, the clear ink composition circulated in the circulation path during recording may be discharged, or the clear ink composition circulated in the circulation path during standby as described later may be discharged. The latter is preferred because the generation of foreign substances in the clear ink composition can be further suppressed. In the latter case, the clear ink composition circulated in the circulation path during standby is discharged at an initial stage after the start of recording. After the discharge of the clear ink composition circulated in the circulation path during standby is completed, alternatively, at the same time as the discharge is completed, the clear ink composition which is not circulated in the circulation path during standby may be discharged.

It is preferable that the ink jet recording apparatus circulates the aqueous clear ink composition during standby. The "standby" means when the ink jet recording apparatus is not recording. During recording, ink rarely stays for a long time in a place where foreign substances are likely to be generated due to ink flow, such as a gas-liquid interface. On the other hand, during standby, the ink remains for a long time in a place where foreign substances are likely to be generated, such as a gas-liquid interface, and the foreign substances are likely to be generated. Therefore, it is preferable to circulate the clear ink composition during standby to prevent the generation of foreign substances. The standby state may be a time when the recording is not performed, for example, a night or a holiday. Further, the standby state may be when recording is not being performed, for example, between recordings. The length of time of the standby is, for example, 10 minutes or more as a continuous time.

When a gas-liquid interface is generated in the circulation path, it is preferable that the ink jet recording apparatus circulates the ink to suppress the generation of foreign substances. The gas-liquid interface may be any place where an interface between ink and air is generated, for example, a place having an air layer such as a sub-tank, a place where air bubbles have been generated such as a filter and an ink flow path, and the like.

Among them, when the area of the gas-liquid interface is large, the effect of suppressing the generation of foreign substances is great, so that the gas-liquid interface having an air layer is preferable. The area of one continuous gas-liquid interface is preferably 1 $cm^2$ or more.

The circulation amount of the clear ink composition in the circulation return path during standby is preferably 0.5 g/min or more per one ink jet head. Further, it is preferably 12 g/min or less. In addition, the circulation amount in the circulation return path is preferably 0.5 g/min to 12 g/min, more preferably 1 g/min to 9 g/min, and further preferably 2 g/min to 5 g/min.

The ink jet recording method may include a primary drying step in which the recording medium to which the ink adheres is heated so that the ink adhered to the recording medium dries immediately during the ink adhesion step. In the primary drying step, a heater provided on the platen, an IR furnace that irradiates above the platen with the IR, an air blowing mechanism that sends air from above the platen to the recording medium, and the like can be used. With or without the primary drying step, the surface temperature of the recording medium at the portion facing the head when adhering the ink to the recording medium is preferably 45° C. or lower, more preferably 40° C. or lower, further preferably 38° C. or lower, and further more preferably 35° C. or lower. Further, it is preferably 20° C. or higher, more preferably 25° C. or higher, further preferably 28° C. or higher, and further more preferably 30° C. or higher. The temperature is the maximum temperature of the surface temperature of the recording medium in the portion facing the head during recording. When the temperature is in the above range, the discharge stability and the image quality become more excellent.

The ink jet recording method may include, during the ink adhesion step, a temperature adjustment step of heating the ink by a heater provided in the head or the ink flow path and discharging the heated ink. By the temperature adjustment step, it is possible to stabilize the temperature of the discharged ink to keep the viscosity constant or to reduce the viscosity. Thereby, the discharge stability becomes more excellent. The temperature of the ink discharged in the ink adhesion step with or without the temperature adjustment step is preferably 45° C. or lower, more preferably 40° C. or lower, further preferably 38° C. or lower, and further more preferably 35° C. or lower. Further, the temperature is preferably 20° C. or higher, more preferably 25° C. or higher, further preferably 28° C. or higher, and further more preferably 30° C. or higher.

The ink jet recording method may include a secondary drying step of further heating the recording medium to which the ink is adhered after the ink adhesion step is completed. In the secondary drying step, heating can be performed by a heating mechanism provided on the downstream side of the head in the transport direction of the recording medium. As the heating mechanism, a heater, an IR furnace, an air blowing mechanism, or the like can be used. In the secondary drying step, the surface temperature of the recording medium is preferably 120° C. or lower, more preferably 100° C. or lower, and further preferably 80° C. or lower. Further, the temperature is preferably 50° C. or higher, more preferably 60° C. or higher, and further preferably 70° C. or higher. When the temperature is in the range, the abrasion resistance becomes more excellent.

—Treatment Liquid Adhesion Step—

The ink jet recording method of the present embodiment may include a treatment liquid adhesion step of adhering the treatment liquid to a recording medium. The treatment liquid can be adhered by using a roller application, a spray application, a bar coat application, a discharge from an ink jet head, or the like. The treatment liquid is preferably adhered by discharging from the ink jet head. The treatment liquid adhesion step is preferably performed before the colored ink adhesion step.

The treatment liquid preferably contains a coagulant for aggregating the components of the ink composition. When the coagulant interacts with the ink composition, the treatment liquid aggregates the components contained in the ink composition to thicken or insolubilize the ink composition. As a result, it is possible to suppress the landing interference and bleeding of the ink composition to be subsequently adhered, and it is possible to uniformly draw lines and fine images. The use of the treatment liquid is preferable in that the components of the ink are aggregated to stop the flow of the ink on the recording medium, and the image quality is excellent even when the ink evaporation rate is low. In addition, since the image quality is excellent even when the evaporation rate of the ink is low, the evaporation rate of the ink can be reduced, and the color difference reduction is excellent.

Coagulant

The coagulant is not particularly limited, and examples thereof include a cationic resin, an organic acid, and a polyvalent metal salt. Among the components contained in the ink composition, examples of the components that are aggregated by the coagulant include the above-described pigments and resins used for the resin particles.

The cationic resin is not particularly limited, and for example, polyallylamine resins such as polyethyleneimine, polydiallylamine, and polyallylamine, alkylamine polymers, primary to tertiary amino groups described in JP-A-59-20696, JP-A-59-33176, JP-A-59-33177, JP-A-59-155088, JP-A-60-11389, JP-A-60-49990, JP-A-60-83882, JP-A-60-109894, JP-A-62-198493, JP-A-63-49478, JP-A-63-115780, JP-A-63-280681, JP-A-1-40371, JP-A-6-234268, JP-A-7-125411, and JP-A-10-193776, and a polymer having a quaternary ammonium salt group are preferably used. The weight average molecular weight of the cationic resin is preferably 5,000 or more, more preferably about 5,000 to 100,000. The weight average molecular weight of the cationic resin is measured by gel permeation chromatography using polystyrene as a standard substance.

Among these cationic resins, cationic amine resins such as polyallylamine resin, polyamine resin, and polyamide resin are preferable in terms of the excellent image quality. The polyallylamine resin, polyamine resin, and polyamide resin are resins having a polyallylamine structure, a polyamine structure, and a polyamide structure in the main skeleton of the polymer, respectively.

The organic acid is not particularly limited, and is, for example, a carboxylic acid. Examples of the carboxylic acid include, although not particularly limited, maleic acid, acetic acid, phosphoric acid, oxalic acid, malonic acid, succinic acid, and citric acid. Among them, monovalent or divalent or higher carboxylic acids are preferred.

The polyvalent metal salt may be a polyvalent metal salt of an inorganic acid or a polyvalent metal salt of an organic acid. Examples of the polyvalent metal salt include, although not particularly limited, alkaline earth metals of Group 2 of the periodic table (for example, magnesium and calcium), transition metals of Group 3 of the periodic table (for example, lanthanum), earth metals of Group 13 of the periodic table (for example, aluminum), and salts of lanthanides (for example, neodymium). As the salts of these polyvalent metals, carboxylate (for example, formic acid, acetic acid, and benzoate), sulfate, nitrate, chloride, and thiocyanate are preferable. Among them, the polyvalent metal salt is preferably calcium salt or magnesium salt of carboxylic acid (formic acid, acetic acid, benzoate, and the like), calcium salt or magnesium salt of sulfuric acid, calcium salt or magnesium salt of nitric acid, calcium chloride, magnesium chloride, and calcium salt or magnesium salt of thiocyanic acid.

The content of the coagulant is preferably 0.1% by mass to 25% by mass, more preferably 1% by mass to 25% by mass, further preferably 1% by mass to 20% by mass, further more preferably 1% by mass to 10% by mass, and still more preferably 1% by mass to 7% by mass, based on the total mass of the treatment liquid. When the content of the coagulant is within the above range, there is a tendency that a recorded matter with higher image quality can be obtained.

The treatment liquid used in the present embodiment may contain the same surfactant, water-soluble organic solvent, and water as those used in the above-described ink composition, independently of the ink composition. Further, the treatment liquid may appropriately contain various additives, as other components, such as, a dissolution aid, a viscosity adjuster, a pH adjuster, an antioxidant, a preservative, an antifungal agent, a corrosion inhibitor, and a chelating agent for trapping metal ions affecting dispersion.

The ink jet recording method of the present embodiment may include the known steps of the ink jet recording method in the related art in addition to the above steps.

EXAMPLES

Hereinafter, the present disclosure will be described more specifically with reference to Examples and Comparative Examples. The present disclosure is not limited at all by the following Examples.

—Preparation of Ink Composition—

Each material was mixed with the composition shown in Table 1 below, and sufficiently stirred to obtain each ink composition. Specifically, each ink was prepared by uniformly mixing the respective materials and removing insoluble matters with a filter. In Table 1 below, the unit of the numerical value is % by mass, and the total is 100.0% by mass. The pigment was mixed with water in advance with a pigment dispersion resin which is a water-soluble styrene acrylic resin not shown in the table, at a weight ratio of 2:1, and stirred with a bead mill to prepare a pigment dispersion, which was used for the ink preparation.

TABLE 1

| | | Colored ink composition | | Clear ink composition | | | | | | | | Treatment liquid |
|---|---|---|---|---|---|---|---|---|---|---|---|---|
| | | Colored A | Colored B | Clear A | Clear B | Clear C | Clear D | Clear E | Clear F | Clear G | Clear H | Treatment A |
| Coloring material | Cyan pigment | 7 | | | | | | | | | | |
| | White pigment | | 12 | | | | | | | | | |
| Water-soluble organic solvent | Propylene glycol | 26 | 16 | 26 | 26 | 26 | 26 | 26 | 26 | 21 | 26 | 26 |
| | 2-pyrrolidone | | | | | | | | | 5 | | |
| Surfactant B | BYK-348 | 1 | 1 | 1 | 1 | 1 | 1 | 1 | 1 | 1 | 1 | 2 |
| Defoaming agent | DF110D | 0.2 | 0.2 | 0.2 | 0.2 | 0.2 | 0.2 | 0.2 | 0.2 | 0.2 | 0.2 | 0.5 |
| Resin particle | 62J | 5 | 5 | 7 | 5 | 7 | 7 | 7 | 7 | 7 | 7 | |
| Wax particle | Wax A | | | | 2 | 2 | 4 | | | 2 | 1 | |
| | Wax B | | | | | | | 2 | | | | |
| | Wax C | | | | | | | | 2 | | | |
| Coagulant | PD-7 | | | | | | | | | | | 5 |
| Water | | 60.8 | 65.8 | 65.8 | 65.8 | 63.8 | 61.8 | 63.8 | 63.8 | 63.8 | 64.8 | 66.5 |
| Total | | 100 | 100 | 100 | 100 | 100 | 100 | 100 | 100 | 100 | 100 | 100 |

Cyan pigment: C. I. Pigment Blue 15:3

White pigment: titanium oxide pigment

BYK-348: silicone-based surfactant "BYK-348" (product name, manufactured by BYK-Chemi GMbH)

DF110D: acetylene glycol-based defoaming agent "Surfinol DF110D" (product name, manufactured by Nissin Chemical Industry Co., Ltd., effective amount 32% by mass)

62J: styrene-acrylic resin emulsion "Joncryl 62J" (product name, manufactured by BASF)

PD-7: cationic substance "Catiomaster PD-7" (product name, manufactured by Yokkaichi Gosei Co., Ltd.)

Wax particles A: polyethylene-based wax particles (nonionic dispersible wax emulsion, average particle diameter 40 nm, manufactured by Toho Chemical Industry Co., Ltd., E1000)

Wax particles B: a polyethylene resin was synthesized and dispersed in water by using a nonionic surfactant. The average particle diameter was adjusted to 200 nm by adjusting the synthetic conditions and dispersion conditions of the resin, and by further classifying with a filter as needed. The resulting dispersion was used as a nonionic dispersible wax emulsion.

Wax particles C: polyethylene-based wax particles (anionic dispersible wax emulsion, average particle diameter 40 nm, manufactured by BYK-Chemi, AQUACER507)

—Ink Jet Recording Apparatus—

For the line printer, "L-4533AW" (product name, manufactured by Seiko Epson Corporation) was modified and used as a line printer.

For the serial printer, "SC-580650" (product name, manufactured by Seiko Epson Corporation) was modified and used as a serial printer.

The platen heater was operated during ink jet recording, and the surface temperature on the recording surface side of the recording medium at the position facing the head (maximum temperature during recording) was 35° C.

A secondary drying mechanism was provided downstream of the head. Drying was performed at a media temperature of 70° C. (maximum temperature).

In the line printer, a treatment liquid head, a colored ink head, and a clear ink head were arranged in this order from the upstream side in the recording medium transport direction, and each composition was adhered in this order.

In the serial printer, a treatment liquid head (only in a case shown in Table 1), a colored ink head, and a clear ink head were arranged in this order from the upstream side in the recording medium transport direction, and each composition was adhered in this order.

The amount of adhesion was 5 mg/inch$^2$ for the colored ink, 1 mg/inch$^2$ for the clear ink, and 1 mg/inch$^2$ for the treatment liquid. The three liquids were recorded in an overlapping order.

The head had a nozzle-row nozzle density of 1200 dpi.

An apparatus having a sub-tank between the ink cartridge and the head and a self-sealing valve between the sub-tank and the head was used. A filter having a mesh diameter of 10 μm was provided at a position of the head where the ink composition is introduced.

As the serial printer, an off-carriage type was used as shown in FIG. 1.

The head is a circulation head, and a head capable of circulating ink as shown in FIG. 2 and subsequent drawings was used. The circulation speed of the circulation return path per head during recording was set to the value shown in the table, and the ink was circulated during recording. However, in the example without circulation, a head without circulation path was used.

The head was equipped with a heater so that the temperature of the ink in the head could be adjusted to discharge the ink. In the example with temperature adjustment, the temperature was adjusted during recording and the ink was discharged at a temperature of 35° C. In the example without temperature adjustment, the temperature was not adjusted, and the temperature of the discharged ink during recording was set to 25° C.

In the example with flushing in the table, in a case of a serial printer, the flushing box provided at a position apart from the recording medium was flushed from the ink jet head for each path. In a case of a line printer, during the recording, the recording was interrupted every 1 minute, the ink jet head was moved to the flushing box to perform flushing, and after the flushing, the ink jet head was returned to resume the recording.

In the example without flushing, no flushing was performed during the recording.

A recording test was performed under such recording conditions.

Ink Jet Recording Method (Examples 1 to 14, Comparative Examples 1 to 7)

Using a modified apparatus, any of the ink compositions prepared as described above was discharged by an ink jet method under the printing conditions shown in Table 2, and the patterns shown in each evaluation item were adhered to the OPP film "Pyrene (registered trademark) film-OT" (manufactured by, Toyobo Co., Ltd., model number: P2111, thickness 20 μm).

Evaluation

Abrasion Resistance

Under the conditions of the above recording test, a rectangular solid pattern (20 cm×20 cm) was continuously recorded on the recording medium. The recorded rectangular solid pattern portion was cut out to a required size, and the degree of peeling of ink when a plain weave cloth was rubbed 100 times with a JSPS ablation resistance tester "AB-301" (product name, manufactured by Tester Sangyo Co., Ltd., load 500 g) was visually evaluated according to the following evaluation criteria. For the recording of the evaluation pattern, a pattern recorded one day after the start of recording was used.

Evaluation Criteria

AA: No peeling in the solid pattern portion.

A: Peeling of 10% or less of the area of the solid pattern portion.

B: Peeling of more than 10% to 30% or less of the area of the solid pattern portion.

C: Peeling of more than 30% to 50% or less of the area of the solid pattern portion.

D: Peeling of more than 50% of the area of the solid pattern portion.

Image Deviation

Under the conditions of the above recording test, a line having a width of 0.5 mm extending in the recording medium transport direction was recorded.

In the example of the serial printer with flushing, inter-path flushing was performed in the middle of line recording, and after the flushing, the line recording was continued. In the example of the line printer with flushing, the head was moved to the flushing box for flushing in the middle of the line recording, and the head was returned to continue the line recording. In the example without flushing, no flushing was performed. The test was performed one day after the start of the recording.

When flushing is performed in a serial printer, flushing is performed between paths, so that the time between the paths was only slightly longer. When flushing is performed in a line printer, the recording position may not be accurately aligned due to the movement of the head.

Evaluation Criteria

A: Non-straight part in the outline of the line is not visible.

B: Some non-straight parts in the outline of the line are visible.

C: Deviation of the straight line in the outline of the line is visible.

Bleed

Under the conditions of the above recording test, a square solid pattern of 5 cm×5 cm was recorded and visually observed.

A: Shading unevenness in the solid pattern is not visible.

B: Shading unevenness in the solid pattern is visible. Foreign Substances Generation Suppression (Head Filter Clogging)

Under the conditions of the above recording test, recording was performed for 8 hours a day, and during a non-recording period, the nozzle cap was closed and the ink composition was circulated to stand by. The circulation amount during standby was set to the value in the table. The circulation amount is the amount of ink discharged from the head to the circulation return path per head. This was repeated for three months. The ink composition in the head was circulated during recording. The circulation amount during recording was set to the amount (g/min) shown in the table. However, the example without circulation was performed without circulating the ink during standby and during recording. Three months later, the head filter was observed. The head filter was provided near the ink inlet of the head. The filter had a mesh diameter of 10 μm.

Evaluation Criteria

A: Solid-form foreign substances are not visible on the filter.

B: Some solid-form foreign substances are visible on the filter.

C: Solid-form foreign substances are considerably visible on the filter.

Discharge Stability

For the head filter clogging test, recording was performed once a day and the discharge inspection for all nozzles was performed. The average value of the nozzle discharge inspection recorded for 3 months was obtained. The inspection was performed by recording a nozzle check pattern.

A: No non-discharge nozzle.

B: Non-discharge nozzle is 0.1% or less of the entire nozzles.

C: Non-discharge nozzles is 0.1% or more of the entire nozzles.

TABLE 2-1

| | | Example 1 | | Example 2 | | Example 3 | | Example 4 | | Example 5 | | Example 6 | | Example 7 | |
|---|---|---|---|---|---|---|---|---|---|---|---|---|---|---|---|
| Ink composition and the like | | Colored A | Clear C | Colored A | Clear C | Colored A | Clear C | Colored B | Clear C | Colored A | Clear D | Colored A | Clear D | Colored A | Clear E |
| Printing method | | line | | line | | serial | | line | | line | | line | | line | |
| Head configuration | Circulation mechanism | With | With | With | With | With | With | With | With | With | With | With | With | With | With |
| | Temperature adjustment | With | With | — | — | With | With | With | With | With | With | — | — | With | With |
| Flushing | | — | — | — | — | with | with | — | — | — | — | — | — | — | — |
| Circulation speed (g/min) | | 3 | | 3 | | 3 | | 3 | | 3 | | 3 | | 3 | |
| Evaluation | Abrasion resistance | A | | A | | A | | B | | AA | | AA | | AA | |
| | Foreign substance generation suppression | A | A | A | A | A | A | A | A | A | B | A | A | A | B |
| | Discharge stability | A | A | B | B | A | A | A | A | A | A | B | B | A | A |
| | Bleed | B | | B | | B | | B | | B | | B | | B | |
| | Image deviation | A | | B | | A | | A | | A | | B | | A | |

TABLE 2-2

| | | Example 8 | | Example 9 | | Example 10 | | | Example 11 | | Example 12 | | Example 13 | | Example 14 | |
|---|---|---|---|---|---|---|---|---|---|---|---|---|---|---|---|---|
| Ink composition and the like | | Colored A | Clear F | Colored A | Clear G | Colored A | Clear C | Treatment A | Colored A | Clear B | Colored A | Clear D | Colored A | Clear C | Colored A | Clear H |
| Printing method | | Line | | Line | | | Line | | Line | | Line | | Line | | Line | |
| Head configuration | Circulation mechanism | With | With | With | With | With | With | With | With | With | With | With | With | With | With | With |
| | Temperature adjustment | With | With | With | With | With | With | With | With | With | With | With | With | With | With | With |
| Flushing | | — | — | — | — | — | — | — | — | — | — | — | — | — | — | — |
| Circulation speed (g/min) | | 3 | | 3 | | 3 | | | 3 | | 5 | | 1 | | 3 | |
| Evaluation | Abrasion resistance | B | | AA | | B | | | A | | AA | | A | | B | |
| | Foreign substance generation suppression | A | AA | A | B | A | A | A | A | A | A | A | A | A | A | AA |
| | Discharge stability | A | A | A | A | A | A | A | A | A | A | A | B | B | A | A |
| | Bleed | B | | B | | A | | | B | | B | | B | | B | |
| | Image deviation | A | | A | | A | | | A | | A | | B | | A | |

TABLE 2-3

| | | Comparative Example 1 | | Comparative Example 2 | | Comparative Example 3 | | Comparative Example 4 | | Comparative Example 5 | | Comparative Example 6 | | Comparative Example 7 | |
|---|---|---|---|---|---|---|---|---|---|---|---|---|---|---|---|
| Ink composition and the like | | Colored A | Clear C | Colored A | Clear C | Colored A | Clear C | Colored B | Clear C | Colored A | Clear A | Colored A | Clear A | Colored A | Clear B |
| Printing method | | Line | | Line | | Serial | | Line | | Line | | Line | | Line | |
| Head configuration | Circulation mechanism | — | — | — | — | — | — | — | — | With | With | — | — | — | — |
| | Temperature adjustment | With | With | With | With | With | With | With | With | With | With | With | With | With | With |
| Flushing | | — | — | With | With | With | With | — | — | — | — | — | — | — | — |
| Circulation speed (g/min) | | — | | — | | — | | — | | 3 | | — | | — | |
| Evaluation | Abrasion resistance | A | | A | | A | | B | | D | | D | | A | |
| | Foreign substance generation suppression | B | C | B | C | B | C | B | C | A | A | B | A | B | C |
| | Discharge stability | C | C | A | A | A | A | C | C | A | A | C | C | C | C |
| | Bleed | B | | B | | B | | B | | B | | B | | B | |
| | Image deviation | C | | C | | A | | A | | A | | C | | A | |

According to the above Examples and Comparative Examples, it can be found that all of the Examples, which correspond to the ink jet recording method of the present embodiment, exhibit excellent abrasion resistance of the recorded matter and the clogging of the head filter is suppressed. On the other hand, in the Comparative Examples, either the abrasion resistance or the filter clogging suppression was inferior.

Although not shown in the table, in Example 1, in the evaluation of foreign substances generation suppression and the evaluation of discharge stability, the circulation during standby was performed, the circulation during the recording was not performed, and then the same evaluation was performed. As a result, the clear ink had the same results as in Example 1, and the colored ink had the same results as in Comparative Example 1. In Example 1, in the evaluation of foreign substances generation suppression and the evaluation of discharge stability, the circulation during standby was not performed, the circulation during the recording was performed, and then the same evaluation was performed. As a result, the clear ink had the same results as in Comparative Example 1, and the colored ink had the same results as in Example 1. From this, it was found that the circulation during standby is preferable in that the foreign substances suppression in the clear ink is more excellent, and the circulation during recording is preferable in that the discharge stability of the colored ink is more excellent.

What is claimed is:

1. An ink jet recording method that uses an ink jet recording apparatus having an ink jet head, the method comprising:

a colored ink adhesion step of discharging an aqueous colored ink composition containing a coloring material from an ink jet head to adhere to a recording medium; and a clear ink adhesion step of discharging an aqueous clear ink composition from the ink jet head to adhere to the recording medium, wherein the aqueous clear ink composition contains wax particles in an amount that ranges between 0.5 to 10% by mass and contains resin particles in an amount that ranges between 1.0 to 15% by mass, the ink jet head has a pressure chamber, a circulation path for circulating the aqueous clear ink composition, a nozzle, a sub-tank, and a liquid container, the aqueous clear ink composition returning to the sub-tank through the circulation path and being re-supplied to the ink jet head, and the liquid container supplying the aqueous clear ink composition to the sub-tank, the pressure chamber is configured to be supplied with the aqueous clear ink composition and configured to pressurize the aqueous clear ink composition to discharge the aqueous clear ink composition from the nozzle, and the circulation path is formed at a position downstream from the pressure chamber and upstream from the nozzle, the ink jet recording apparatus circulates the aqueous clear ink composition during standby, and in the clear ink adhesion step, the aqueous clear ink composition circulated in the circulation path is discharged.

2. The ink jet recording method according to claim 1, wherein the aqueous clear ink composition contains 1 to 10% by mass the wax particles.

3. The ink jet recording method according to claim 1, wherein the wax particles have an average particle diameter of 30 nm to 500 nm.

4. The ink jet recording method according to claim 1, wherein the aqueous clear ink composition contains resin particles in an amount that ranges between 2.0 to 15% by mass.

5. The ink jet recording method according to claim 1, further comprising:

adhering a treatment liquid containing a coagulant to the recording medium.

6. The ink jet recording method according to claim 1, wherein the aqueous clear ink composition contains a nitrogen-containing solvent.

7. The ink jet recording method according to claim 1, wherein the recording medium is a low-absorptive recording medium or a non-absorptive recording medium.

8. The ink jet recording method according to claim 1, wherein the circulation path includes at least one of a circulation return path for returning the aqueous clear ink composition from the ink jet head and a circulation return path for returning the aqueous clear ink composition from an ink flow path for supplying the aqueous clear ink composition to the ink jet head.

9. The ink jet recording method according to claim 1, wherein a gas-liquid interface is generated in a circulation path for circulating the aqueous clear ink composition.

10. The ink jet recording method according to claim wherein a circulation amount of the aqueous clear ink composition in the circulation return path during the standby is 0.5 g/min to 12 g/min per one ink jet head.

11. The ink jet recording method according to claim 1, wherein the ink jet recording apparatus has the circulation path for circulating the aqueous colored ink composition, and in the colored ink adhesion step, the colored ink composition circulated in the circulation path during recording is discharged.

12. An ink jet recording apparatus that performs recording by the ink jet recording method according to claim 1, the apparatus comprising:

a first ink jet head that discharges an aqueous colored ink composition containing a coloring material to adhere to a recording medium;

a second ink jet head that discharges an aqueous clear ink composition to adhere to the recording medium; and a circulation path for circulating the aqueous clear ink composition.

* * * * *